US010438448B2

(12) United States Patent
Piccionielli

(10) Patent No.: US 10,438,448 B2
(45) Date of Patent: Oct. 8, 2019

(54) COMPOSITION PRODUCTION WITH AUDIENCE PARTICIPATION

(71) Applicant: Gregory A. Piccionielli, Westlake Village, CA (US)

(72) Inventor: Gregory A. Piccionielli, Westlake Village, CA (US)

( * ) Notice: Subject to any disclaimer, the term of this patent is extended or adjusted under 35 U.S.C. 154(b) by 135 days.

(21) Appl. No.: 13/815,824

(22) Filed: Mar. 15, 2013

(65) Prior Publication Data

US 2013/0310122 A1 Nov. 21, 2013

Related U.S. Application Data

(63) Continuation-in-part of application No. 12/381,574, filed on Mar. 12, 2009, now abandoned.

(60) Provisional application No. 61/124,224, filed on Apr. 14, 2008.

(51) Int. Cl.

| | |
|---|---|
| ***G10H 1/00*** | (2006.01) |
| ***G10H 1/36*** | (2006.01) |
| ***G07F 17/32*** | (2006.01) |
| *H04R 27/00* | (2006.01) |

(52) U.S. Cl.

CPC ..... *G07F 17/3272* (2013.01); *G10H 1/0058* (2013.01); *G10H 2220/121* (2013.01); *G10H 2240/175* (2013.01); *G10H 2240/181* (2013.01); *H04R 27/00* (2013.01); *H04R 2227/003* (2013.01)

(58) Field of Classification Search

CPC ..... H04W 4/02; H04W 4/023; H04W 4/80; H04W 64/00; H04W 4/029; H04W 84/12; H04W 4/025; H04W 64/003; G10H 2220/111; G10H 2240/075; G10H 2220/355; G10H 2240/211; H04B 7/18526; H04B 1/38; H04B 1/3827

See application file for complete search history.

(56) References Cited

U.S. PATENT DOCUMENTS

| | | | | |
|---|---|---|---|---|
| 7,423,213 | B2 * | 9/2008 | Sitrick | G09B 15/023 84/470 R |
| 8,121,990 | B1 * | 2/2012 | Chapweske | G06F 17/30174 707/695 |
| 8,234,150 | B1 * | 7/2012 | Pickton | G06Q 10/101 705/7.31 |
| 8,319,816 | B1 * | 11/2012 | Swanson | H04L 12/1818 348/14.01 |
| 8,395,652 | B1 * | 3/2013 | Chapweske | H04L 12/1881 348/14.05 |
| 8,538,458 | B2 * | 9/2013 | Haney | H04W 4/21 455/456.2 |
| 8,605,132 | B1 * | 12/2013 | Swanson | H04N 7/152 348/14.01 |
| 8,682,653 | B2 * | 3/2014 | Salazar | G10H 1/366 340/539.13 |
| 8,769,557 | B1 * | 7/2014 | Terrazas | H04N 21/44218 725/12 |
| 8,802,957 | B2 * | 8/2014 | Barker | H04H 60/05 463/31 |
| 8,868,411 | B2 * | 10/2014 | Cook | G10H 1/366 704/207 |

(Continued)

*Primary Examiner* — Merlon T Fletcher
(74) *Attorney, Agent, or Firm* — Gregory B. Gulliver

(57) ABSTRACT

Methods are provided for enabling audience members at a live or substantially live performance to interact with performers and participate in the performance.

11 Claims, 10 Drawing Sheets

(56) References Cited

U.S. PATENT DOCUMENTS 8,962,964 B2 * 2/2015 Emmerson ..... G10H 1/0025 84/600
9,210,200 B1 * 12/2015 Chapweske ..... H04L 12/18
9,235,552 B1 * 1/2016 Eck ..... G06F 17/00
2005/0165643 A1 * 7/2005 Wilson ..... G06Q 30/02 705/14.53
2006/0247046 A1 * 11/2006 Choi et al. ..... 463/36
2006/0258457 A1 * 11/2006 Brigham ..... A63F 13/12 463/36
2008/0060499 A1 * 3/2008 Sitrick ..... G09B 15/002 84/477 R
2008/0092062 A1 * 4/2008 Motsinger ..... G06Q 10/00 715/753
2009/0070797 A1 * 3/2009 Ramaswamy ..... H04L 12/66 725/10
2009/0087161 A1 * 4/2009 Roberts ..... G11B 27/031 386/282
2009/0094375 A1 * 4/2009 Lection ..... G06F 15/16 709/231
2009/0113022 A1 * 4/2009 Quoc ..... G06Q 10/10 709/218
2009/0132925 A1 * 5/2009 Koehler ..... G09B 5/10 715/730
2009/0144391 A1 * 6/2009 Jung ..... G06Q 10/10 709/217
2009/0264070 A1 * 10/2009 Lim ..... G06Q 30/0261 455/41.2
2009/0286601 A1 * 11/2009 Rubio ..... G07F 17/3295 463/36
2010/0207874 A1 * 8/2010 Yuxin ..... G06F 3/017 345/156
2010/0307321 A1 * 12/2010 Mann ..... G06F 3/0481 84/613
2011/0271295 A1 * 11/2011 Redmann ..... G06K 9/00496 725/13
2012/0208639 A1 * 8/2012 Reynolds et al. ..... 463/36
2012/0249443 A1 * 10/2012 Anderson et al. ..... 345/173
2013/0025437 A1 * 1/2013 Serletic ..... G10H 1/0025 84/634
2013/0102419 A1 * 4/2013 Jeffery et al. ..... 473/409
2013/0150121 A1 * 6/2013 Jeffery et al. ..... 455/556.1
2013/0262293 A1 * 10/2013 Garner, Jr. ..... G06Q 10/10 705/39
2013/0269504 A1 * 10/2013 Seese, Jr. ..... G10H 1/0025 84/609
2013/0310122 A1 * 11/2013 Piccionielli ..... G07F 17/3272 463/2
2014/0007147 A1 * 1/2014 Anderson ..... H04H 60/33 725/9
2014/0053710 A1 * 2/2014 Serletic, II ..... G10H 7/00 84/609
2014/0071069 A1 * 3/2014 Anderson et al. ..... 345/173
2014/0104274 A1 * 4/2014 Hilliges et al. ..... 345/424
2014/0180451 A1 * 6/2014 Marty ..... 700/91
2014/0207564 A1 * 7/2014 Dubey ..... G06Q 30/02 705/14.43
2014/0258275 A1 * 9/2014 Paritosh ..... G06F 17/3097 707/723
2014/0258400 A1 * 9/2014 Paritosh ..... H04L 67/306 709/204
2014/0273811 A1 * 9/2014 Czapla ..... H04H 20/61 455/3.06
2014/0328485 A1 * 11/2014 Saulters ..... G06F 3/165 381/17
2015/0012308 A1 * 1/2015 Snyder ..... H04W 84/18 705/5
2015/0079962 A1 * 3/2015 Baker ..... H04W 8/18 455/418
2015/0081734 A1 * 3/2015 Mason ..... G06F 17/30876 707/772
2015/0339034 A1 * 11/2015 Garcia ..... G06F 17/241 715/738
2016/0080892 A1 * 3/2016 Basalamah ..... H04W 4/023 455/41.2
2016/0366197 A1 * 12/2016 Dharmaji ..... H04L 65/4076
2017/0024094 A1 * 1/2017 Gresham ..... G06F 3/0484
2017/0032336 A1 * 2/2017 Connell ..... G06Q 20/10
2017/0048282 A1 * 2/2017 Dharmaji ..... G06F 3/0482
2017/0200474 A1 * 7/2017 Gudewicz ..... G11B 27/036
2017/0316809 A1 * 11/2017 Gudewicz ..... H04R 1/406

* cited by examiner

COMPOSITION PRODUCTION WITH AUDIENCE PARTICIPATION

This application is a continuation-in-part of U.S. patent application Ser. No. 12/381,574, filed Mar. 12, 2009, which in turn was based on U.S. Provisional Patent Application Ser. No. 61/124,224, filed Apr. 14, 2008, the entire disclosures of which each of which are incorporated herein by reference and priority of each of which is claimed.

FIELD OF THE INVENTION

The present invention relates to methods for producing a composition, such as a musical composition or a visual composition such as a painting. More particularly, the present invention relates to methods enabling live performers and audience members jointly to produce musical, artistic or other works, each such work being uniquely created during a particular performance at a particular performance venue.

BACKGROUND OF THE INVENTION

Presently, audience participation at events such as musical concerts, plays, literary readings and the like, is limited to expressions of approval, such as cheering, shouting out requests for specific songs, clapping, or lighting cigarette lighters. However, the proliferation of cellular telephones, camera phones, and more advanced telecommunication devices such as I-Phones®, has created the possibility for more active collaboration between performers and their audiences, and for the creation of unique works of music, theater, painting, literature, educational events, sporting events, contests, political, religious events and the like resulting from such collaboration.

A need exists for methods of producing compositions, such as songs, paintings, educational events, sporting events, contests, games, and the like, which afford audience members the opportunity to make contributions to the compositions.

A need also exists for methods of producing such unique compositions which further allows for the production of customized recordings uniquely associated with the live performances upon which they are based.

SUMMARY OF THE PREFERRED EMBODIMENTS

In accordance with one aspect of the invention, there is provided a method of producing a composition, such as, but not limited to, a live show, such as a concert or other live musical production, a live theatrical production, such as a play or opera, an educational event, such as a lecture, class, a religious event, such as a mass, a political event, such as a political rally, a sporting event, such as a baseball game, or any other live or substantially live performance having one or more primary components generated by one or more non-audience performers and one or more secondary components generated by one or more audience members. In some embodiments, the non-audience performer, sometime referred to as a "primary producer" is a person, such as a musician, teacher, priest, speaker, show director, etc., alone or though the use, or assistance, of the Collaborative Show Production System ("CSPS").

The CSPS, is the inventive system described and exemplified herein that enables audience members to participate in performances by non-audience performers, and to do so using telecommunication devices in a wide variety of circumstances, including without limitation, in performances (e.g., shows, educational events, religious events, political events, sporting events, etc.) at which and during some or all of such performances one or more audience members and one or more non-audience performers are simultaneously physically present, one or more audience members are present via an online means (such as by teleconferencing), one or more non-audience performers are present via an online means, one or more audience members and/or one or more non-audience performers are physically present in one or more different locations and virtually present at the performance, such as by teleconferencing or through the use of (i) a massively multiuser virtual environment ("MMVE" technology, (ii) online gaming technology, or (iii) other virtual world technology or the like, ((i), (ii) and (iii) collectively referred to as "Virtual World Technology"), and performances at which one or more non-audience performers and/or one or more audience members are present via recordings. The term "telecommunication device" refers to any device capable of accessing a telecommunication network and transmitting and/or receiving data via a network so accessed, and includes, without limitation, cellular telephones, smart phones, such as an iPhone®, a Droid® or a Galaxy®, a tablet computer, such as a iPad®, other portable computing devices, such as tablet computers, phablet computers, wearable computers, such as, without limitation, computing devices configured to be worn about the wrist U.S. Pat. No. 13/815,763, entitled Wrist Phone, inventor Gregory A. Piccionelli, filed on Mar. 15, 2013, computing devices comprising or associated with clothing, heads-up display devices (HUD's), including without limitation devices adapted to be worn by a user and capable of accessing a telecommunication network, such as "Google Glass™", etc., and similar devices incorporated into an object like a shirt, binoculars, water bottle, etc. The telecommunication device may also be a device provided by the producer, such as a speaker unit capable of interfacing with the CSPS system directly or through the user's device (like a smart phone), a wearable display, such as a flexible display in a shirt, parka, hat, etc., or a combination of wearable display and wearable sound generating devices. In some embodiments, the primary component is generated by CSPS itself (for example, when the primary component is a recording, a stage effect or a special effect.

In some embodiments of the invention both the primary and secondary components are produced live or substantially live. It is to be understood that the term "live" as used in this disclosure shall be broadly construed to mean either live or substantially live, such as when part of the matter or action described as "live" is associated with or effectuated through a medium, such as the Internet, in which there may be inherent latency, transmission delays, and the like. It is also to be understood that association of prerecorded material with live material may also be referred to as "live" when such components are expressly or implicitly referred to jointly. In some embodiments of the invention all or part of the primary and/or secondary components are produced live.

In some embodiments, the performance(s) generated through the use of the CSPS may generated and/or displayed in whole or in part in a virtual world environment through the use of Virtual World Technology. In some embodiments the performance includes audio, video, textual and/or haptic components.

In some embodiments creation of a performance includes the steps of: generating a primary performance component (sometimes referred to as a "primary component"), such as a live, recorded, or partially live and recorded performance such as (i) the performance by one or more performers of a song or other musical piece, a concert, a live show, a live theatrical production, an opera, one or more theatrical scenes, or any other type of live artistic performance, (ii) the performance of athletic acts, such as in a baseball, basketball, football or other type of sports game, an athletic contest or other athletic event, (iv) the performance of a game, such as a video game, virtual reality game, enhanced reality game, etc., (v) the performance of a lecture, a class, an instruction or other live or recorded educational event, the primary component being generated by a primary producer, such as, for example, one or more performers, such as musicians, singers or actors in a band, show, concert, opera, or theatrical production, an athlete playing or otherwise performing in a sporting event, a teacher or lecturer, a person controlling effects for a show, concert, or other event, or any other person who renders a performance for an audience, class, or other group live or via a telecommunications means; generating a secondary component, the second component being generated by a secondary producer though the use of one or more telecommunication devices in the possession and/or under the control of one or more audience members or other secondary producers, where such secondary component is produced by the one or more audience member secondary producers before, during and/or after the first step; and combining the primary component and the secondary component to produce one or more performance compositions.

In some embodiments, the type and/or means by which the secondary producers generate the secondary component is selected from a menu provided to the secondary producer audience members electronically, such as to their telecommunication device(s) in their possession, by one or more primary producers directly or via one or more human or artificial agents (including, without limitation, for example, digital agents such as computers).

In particular embodiments, one or more performers or other primary producers generate the primary component(s) by performing such primary component(s) before an audience that includes at least one secondary producer (e.g. audience member, etc.).

The secondary producer, in some embodiments, is provided with an application that generates the secondary component through the use of one or more telecommunication devices possessed by the subject secondary producer(s) at the time of the production of the show, concert, etc. In some embodiments, the application includes one or more menus, and the secondary producer selects the secondary component or the functionality for the audience member secondary producer to generate and/or facilitate the transmission of the secondary component, from the one or more menus, which causes the application to generate the secondary component and/or provide the means for such secondary component to be provided to the CSPS for inclusion, in and/or combination with, the primary component to produce a collaborative performance. In some specific embodiments, the secondary producer accesses the application using one or more telecommunication devices.

According to particular embodiments, one or more primary producers, through the use of the CSPS combines the primary component and the secondary component. In certain of such embodiments, the secondary producer provides the secondary component to the primary producer using one or more telecommunication devices in communication with the CSPS.

In some embodiments the partial or full control of one or more functions of the telecommunications devices in the possession of some or all of the of secondary producers, such as audience members at a performance, is controlled by the CSPS and/or one or more participants in the CSPS (e.g., a sound technician, light operator, show producer, etc.). Thus, according to further embodiments, control of at least one function, or part thereof, of at least one telecommunication device in the possession of at least one secondary producer, e.g., audience member, is provided to the CSPS. Such control in some embodiments is effectuated during at least a portion of the primary performance component. In some embodiments, such control is effectuated prior to or after the primary performance component. Such functions include, without limitation, camera functions, microphone functions, display generating functions, display content functions, display quality functions, sound inputting functions, sound outputting functions, other data inputting functions, such as touchscreen functions and/or gesture control functions, file retrieval functions, outputting functions, location reporting functions, ringer functions, vibration functions, nearfield communication functions, outgoing or incoming call functions, screen illumination functions, application initiation functions, application control functions, etc.

In some embodiments, where such control, or part thereof, is provided to the CSPS before a performance, such as when the audience member's telecommunication device is located within a predetermined zone in or near the venue at which the concert, play, lecture, sporting event, etc., is to occur, the CSPS may be configured to communicate with the user's telecommunication device to obtain such control over such functions. In some preferred embodiments such control is obtained in association with the online purchase of a ticket to the subject event performance. For example, the process of such an online ticket purchase may require the purchaser to provide information regarding the performance attendee's telecommunication device to enable the CSPS to communicate with the telecommunications device and effectuate such control in association with the performance and/or, in some embodiments, at times before or after such performance.

In some embodiments such control, and/or one or more types of control that are in addition to that previously provided by the possessor of the telecommunications device is provided to the CSPS after the performance. For example, when the audience member's telecommunication device is located within a predetermined zone, the CSPS may be configured to communicate with the user's telecommunication device to obtain such control over such functions. For example, as the audience member is driving away from the performance venue, a performance sponsor's or an advertiser's message might be displayed. Such messages could be displayed in accordance with the location of the audience member, or based on the route the audience member took to the performance venue.

It is to be understood that in some embodiments where the CSPS will use or control one or more functions of an audience member's (or performer's) telecommunication device, such use or control will often be preceded with an initial communication between the telecommunication device and the CSPS so that the CSPS can determine the type of operating system the device uses so that appropriately configured instructions, content, etc., from the CSPS can be used with the device. Such communication may, in some embodiments occur when the telecommunications device is within a predetermined area, such as when it enters into the performance venue. In some such instances, the telecommunication device may receive a digital query or informational request, or the user may receive a message requesting that the device connect with the CSPS system. In some embodiments when a ticket is electronically purchased, or a reservation is electronically made (online for example, or via a mobile device, for example) for the performance that will include the use of the CSPS, such initial connection or permission enabling such initial connection at a later time and place (such as when the telecommunication device nears the venue on the day of the performance), can be effectuated as part of the payment or reservation process.

In some preferred embodiments, a request for authorization for the obtaining of control of one or more functions or features of the telecommunications device is displayed on the telecommunication device (or on another device in instances such as when connection authorization is provided during a ticket sale or reservation on a desktop computer), and such control is not provided to the CSPS unless authorization is provided by the user (or owner) of the telecommunication device. In some preferred embodiments the user may be presented with a menu of possible control/data access authorizations. Such a menu might include, for example, a request for: (i) authorization to link the user's telecommunication device with the CSPS, (ii) authorization to use and/or control the telecommunication device's display(s) to display content associated with the performance, (iii) authorization to use and/or control the telecommunication device's speakers and/or sound generation means to perform sonic content associated with the performance, (iv) authorization to use and/or control the telecommunication device's camera(s) to capture visual data (such as the audience member's visual performance contribution for use in the performance, (v) authorization to use and/or control the telecommunication device's microphone(s) to capture audio data (such as the audience member's singing, questions, or other audio performance contribution), (vi) authorization to provide virtual instrument applications and data associated therewith, (vii) authorization to transmit one or more apps, software, code, etc., to the user's telecommunication device, (viii) authorization to transmit to the device and/or display on the device lyrics or other text, graphics, photographs, videos, etc., (ix) authorization for the CSPS to access location data from the user's telecommunication device, such as location information and/or location determining applications; (x) authorization to access data on or associated with the telecommunication device, such as operating system, brand, model, device IDs, user information, user contacts, photographs, videos, songs, emails, applications resident on the device, data associated with such applications, device location history, search history, preferences, etc., (xi) authorization to open and use applications resident on the telecommunications device, (xii) authorization to control the device's ringer and/or vibration functions, etc.

In additional particular embodiments, one or more secondary producers, such as audience members, have in their possession telecommunication devices enabling access to information stored on, or accessible through such telecommunication devices in their possession, such as digitally stored photographs, stored videos, stored contacts, stored device location history, stored Internet search data, stored texts or tweets, or other sources of personal information, such as for example information that may be used in conjunction with a "digital diary", such as information that may be used in conjunction with a digital diary described in U.S. patent application Ser. No. 13/668,301 entitled "Automatic Diary for an Electronic Device" filed on Nov. 4, 2012 ("Automatic Diary Patent Application"), device preference settings, ticket purchase information, event seat or other locational information regarding where the attendee will attend an event. In some particular embodiments, such devices may be mined for data, and in some embodiments, the mined data may be incorporated, in whole or in part, into the secondary component. A secondary component, in some embodiments, may be comprised partially or entirely of such mined data or such mined data may be used by the CSPS as one or more selective criteria to provide one or more secondary components, or the functionality(ies) for the audience member secondary producer to generate the secondary component from among a plurality of secondary components or functionalities. The resulting performance or show piece, song production, scene production, game play, or other composition can be recorded or otherwise reproduced according to additional particular embodiments, thus allowing the composition to be made available to the secondary producer or others. For example, a recording could be made of the resultant show that includes the audience member's participation, such recording, stored on a server (e.g., a server maintained by the show producer) could be downloaded by the participating show attendee from the server. Two or more secondary producers can participate in the production of the composition. Thus, according to additional specific embodiments, a plurality of secondary producers generate a plurality of secondary components, and thus a plurality of compositions are produced, each composition including the primary component and at least one of the plurality of secondary components. In some embodiments, a show producer may want to limit the way an audience member participates in the show using the CSPS. For example, in some embodiments involving multiple secondary producers' participation in the production, a counter tracks the number of times each secondary component is selected from the menu. A maximum is specified for each secondary component such that a secondary component is removed from the menu when the maximum specified for such secondary component is met. Such embodiments prevent excessive duplication of identical secondary components that are contributed to the final composition. For example, if an audience participant is offered three instruments, say a tambourine, a shaker and a cowbell to play on his or her phone along with a band in a particular song, the band or show producer could configure the CSPS to control the relative number of selected instruments in the audience so that there is not a disproportionate number of one or more of the selectable instruments in the overall sound mix.

In some embodiments, the CSPS provides to the audience member's telecommunication device an application that enables the audience member to make a recording of the audience participation composition merged with the non-audience performance component(s) according to further particular embodiments, and, more specifically, a secondary producer may be identified through the CSPS and provided with a recording including the primary component and the secondary component generated by the secondary producer so identified.

The inventive method is beneficially practiced in producing compositions of an artistic nature. Thus, according to certain particular embodiments, the composition is a musical composition, such as a song performed by a band during a concert before an audience. In such embodiments, the primary component can include, for example, at least one part selected from the group consisting of a vocal part or track and an instrumental part. In some embodiments, a secondary component is then selected from the group consisting of at least one vocal part, at least one percussion part and at least one other instrumental such as a guitar or piano part.

According to certain additional particular embodiments, the composition is a visual artwork, such as a painting, a drawing, a film, a video, a photograph, or a computer-generated graphic work. In these embodiments, the secondary component can be selected, for example from groups consisting of at least one color and at least one shape. In some embodiments the participant could be provided with a plurality of means of generating the secondary component. Where the visual artwork is a computer generated painting or drawing, for example, such means might be an electronic brush, roller, or pencil, etc.

Compositions produced according to embodiments of the inventive method are not limited to a single medium, such as music or a visual artwork. Thus, in additional specific embodiments, the composition so produced may include elements produced in a plurality of media, such as audio, visual, or other media.

In addition to enabling cooperative production of compositions between a primary producer and one or more secondary producers, embodiments of the inventive method enable cooperative determination of the viewing environment of a performance. Thus, in accordance with another aspect of the present invention, there is provided a method of producing a performance for viewing by a viewer. The viewer is provided with a device enabling the viewer to view an image of a performance in combination with a secondary performance component. The method includes the steps of: generating a primary performance component, the primary performance component being generated by a primary producer; selecting a secondary performance component; and enabling the viewer to view the primary performance component in combination with the secondary performance component during the performance thereof.

In particular embodiments, the primary performance component is performed by the primary producer before a live audience comprising the viewer or a plurality of viewers.

The secondary performance component, in more specific embodiments, is selected from a menu provided to the viewer by use of the telecommunication device. More particularly, the secondary performance component may be selected from a group, such as a group consisting of a background still image, a background moving image and an alphanumeric sequence.

In some preferred embodiments, the performance may be recorded from a plurality of locations or viewpoints in the audience or otherwise in the venue or event location, including, in some embodiments where such viewpoints, etc., are those associated with particular audience members as a result of the use of their mobile device in association with the CSPS.

In accordance with another aspect of the present invention, there is provided a method of producing a visual display including a plurality of pixels during a performance by a plurality of telecommunication devices possessed by, or otherwise associated with a plurality of audience members or other type(s) of secondary producer(s). In some embodiments, the visual display including a plurality of pixels may be produced, in part by one or more telecommunication devices possessed by, or otherwise associated with one or more performers or other primary producers, alone or in association with the audience or other secondary producers. The method includes the steps of identifying a location of each of a plurality of audience members (and/or performers) at a venue at which a primary producer gives a performance, each of the secondary producers possessing a telecommunication device having a viewing screen; and, in some embodiments, providing to each of the plurality of secondary producers an instruction to activate and elevate the viewing screen of the telecommunication device at a specified time during the performance by the primary producer. Each of the viewing screens thereby produces one of the plurality of pixels of the visual display. In this way, a performance producer using the CSPS can convert an entire audience into one large display for displaying photographic, video, graphic or textual material, for example, in synchronicity with music, etc. In this way, effects such as a videographic version of an audience "wave" can be made to sweep around the performance venue.

In some preferred embodiments, the control of the audience members telecommunications devices sound generation means by the CSPS will allow sound to added to and/or coordinated with such visual display. In this way, continuing with the audience "wave" example, sound(s) that the producer of the performance desires to be associated in synchronicity with the audience wave can be made to be generated from specified telecommunication devices in locations coordinating with the visual information that is being displayed on the audience members' telecommunication devices. For example if a particular sound, like a cannon blast is to be coordinated in a performance using the CSPS with a 100 foot visual representation of a cannon detonating displayed as one contiguous image via the aggregated cooperative use of several hundred audience members' telecommunication device displays in the back seating section of the performance venue, when the detonation image is displayed on the displays of the telecommunication devices possessed by audience members located in the back seating part of the venue, whereby each such display functions as a "pixel" of such displayed image, coordinated audio information could be sent to the telecommunications devices causing such devices to display (on their displays) the representation of the cannon detonating in synchronicity with the sonic representations of the cannon detonation which is played through the telecommunications devices' sound generating means (e.g., by playing digital information corresponding to the sound through the device's sound file player, amplification system and loudspeakers). In the preceding example, the telecommunication devices producing the detonation sound could be limited to a subset of the telecommunication devices producing the cannon display, for example to those corresponding with the muzzle and barrel area in the display, in order to produce a more realistic sound effect.

In some preferred embodiments, the location specific use of the audience's telecommunications devices' sound generation means could be used aesthetically by non-audience performers such as by a guitar player that plays a guitar riff on stage and then points to the upper left back of the venue where a CSPS engineer can trigger a repeat of the sound by the use of telecommunication devices sound generating means in the location pointed to by the guitar player. This could be accomplished by the digital recording of the riff by the CSPS transmission of the file corresponding to the recording of the riff to the selected telecommunications devices located in the desired part of the venue and instructing such devices to play the transmitted sound file via the telecommunications device's sound generation means. In some embodiments, the CSPS would use previously acquired locational information (e.g., by GPS, intra-venue locational system, seat location, etc.) regarding the locations of such devices to effectuate the aforementioned "targeted" generation of sound from audience telecommunications devices.

In some embodiments, the location of the audience participant is determined by means of employing location sensing and location reporting functionalities in the audience member's telecommunication device. In some embodiments, such functionalities use the Global Positioning System ("GPS") In some embodiments the previously recorded location of seat location corresponding to that indicated on ticket or similar authorization sold or otherwise associated with the participant can be used. In some other embodiments, a locational system in the venue, such as one that uses signal triangulation, can be used. In some embodiments, a combination of the aforementioned means is used to determine the location of the telecommunication device(s) in audience participant's possession. It is to be understood that the same means of determining telecommunication device location may be used to determine the location of telecommunication devices associated with non-audience performers. The same means of determining telecommunication device location may be used to determine the location of telecommunication devices associated with objects used in a performance in association with the CSPC, such as aerial devices (e.g., radio controlled hovering devices), terrestrial vehicles, mobile pyrotechnics, mobile cameras, robots, etc. In some embodiments, such devices can be equipped with one or more spotlighting devices, one or more cameras, one or more microphones, etc., to spotlight one or more audience members and/or capture audio and/or video of one or more audience members in a desired audience location.

Other features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
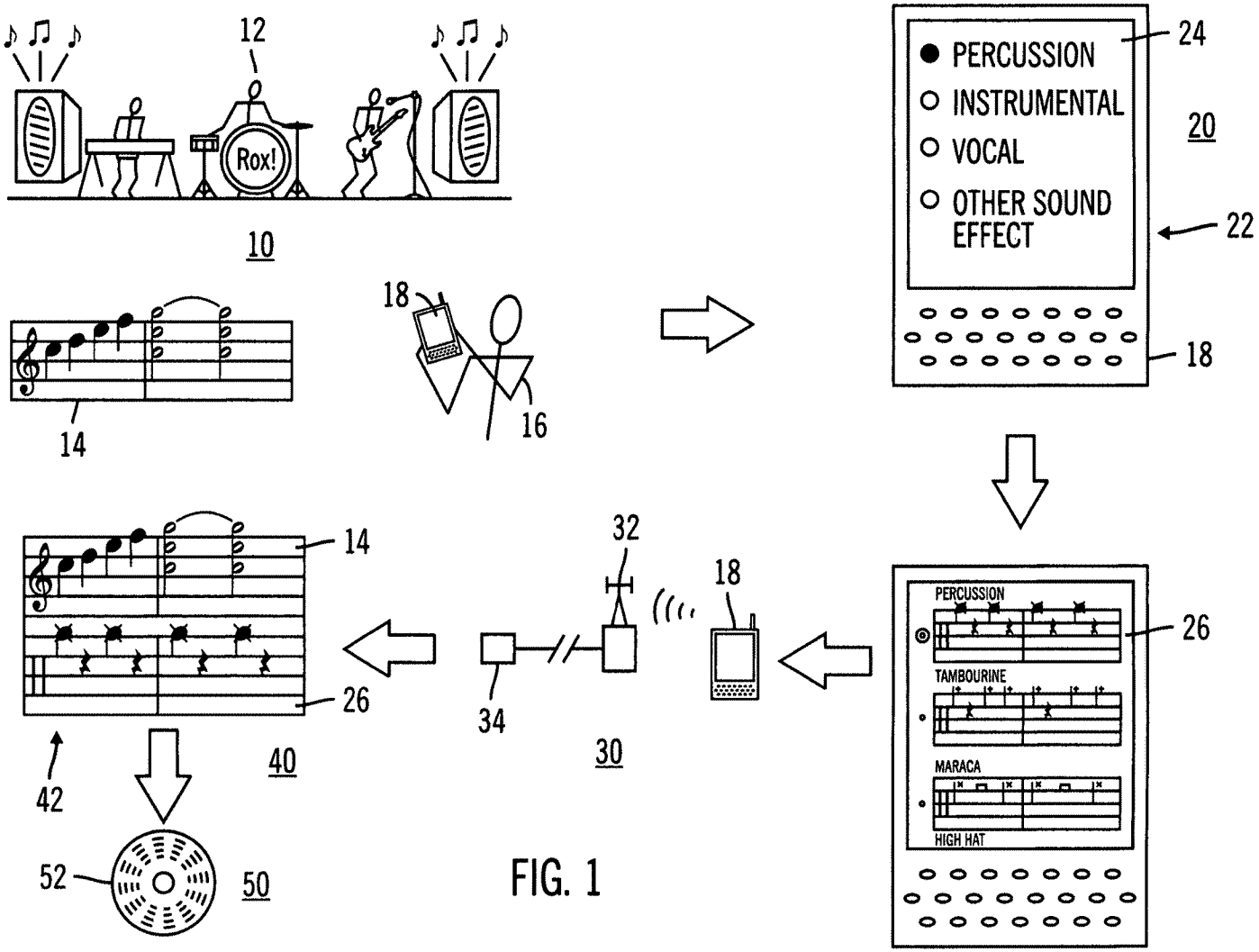
FIG. 1 is a diagram illustrating a first embodiment of a method according to the invention in which a musical composition is produced by a primary producer (a rock band) performing before an audience including a secondary producer (a viewer of the performance). The secondary producer selects a percussion instrument, specifically a tambourine part, as the secondary component to be combined with the primary component, namely a song performed by the band, including vocal, instrumental and percussion parts or tracks. The composition so produced is then recorded.

Methods according to the invention afford audience members the opportunity to add to live performances or presentations they witness or attend, thus creating unique compositions, such as live versions of songs, that have added value as compared to conventionally produced compositions. More generally, methods according to the invention facilitate live interaction between one or more performers and an audience of one or more viewers of a performance by the performer(s), thus allowing the audience member(s) to participate in the live performance or experience the performance in part through the use of a telecommunications device.

As used herein, a "composition" includes any creative expression, in any medium, whether audio, visual or other, including without limitation musical works with or without accompanying lyrics, visual works such as paintings, photographs, videos, films, digital or other computer-generated images, written works such as stories, books, plays, scripts, performances such as dances, etc. A "primary producer" is any person or group of persons who initiate the production of the composition. The production so initiated generates the "primary component" of the composition. A "secondary producer" is any person or plurality of persons who generate(s) an element that is submitted according to the methods described herein for combination with the primary component to produce the composition. In some embodiments, however, the resulting composition is available only to the audience member (such as where the combination is combined with the primary part and/or recorded on the audience member's telecommunication device) and is not submitted to the producer for combination and/or recording with the primary part. The element so generated by one or more audience members is a "secondary component." Compositions produced according to various embodiments of the inventive method can include one secondary component or a plurality of secondary components, and the production processes can involve one secondary producer or a plurality of secondary producers, each of whom can contribute one or more secondary components for combination with the primary component to produce a finished composition. A "menu" can be any listing of components available to a secondary producer for selection as a secondary component of the composition to be produced according to a method of the invention, whether generated by means of a computer application, such as when one or more menus is(are) displayed on the audience participant's telecommunication device display, displayed on one or more venue displays, or produced by any other means, such as by printing on a hard copy that is distributed to and read by a secondary producer. In some embodiments a menu can include multiple menus. In some embodiments, a menu can include certain permissions, authorizations or denials of authorization for the CSPS or the producer through the use of the CSPS to control certain functions of the telecommunication device. Some examples of such functions are, location determination and transmission of location data features, phone ring/not ring, call receive/not receive (send to voicemail), device display functions, device camera functions, video capture functions, device sound producing functions (such as device headphone or speaker activation and/or play of content through internal speakers and/or headphones, transmission to external amplifiers and/or speakers, etc.), acquisition of data on the device, such as access to contacts, access to purchase data, previous location information, etc., texting functions, web browsing functions, near-field communication functions, blue tooth functions, etc. The components so listed can be pre-specified, or alternatively can be newly created by a secondary producer using an appropriate application such as music-writing computer software. The menus can also be interactive with the performance, meaning that as the performance progresses, certain menu options can dynamically be presented to audience participants, or selected parts thereof.

Referring now to FIG. 1, in step 10 a primary producer 12 (as shown, the rock band "Rox!") generates the primary component 14 of a composition, which includes an instrumental part or track as shown, as well as additional instrumental, percussion and vocal parts or tracks (omitted). Secondary producer 16, while viewing the performance of primary producer 12 from an audience, employs a telecommunication device 18. In step 20, secondary producer 16 accesses a first page of a menu 22 provided to telecommunication device 18, and selects a secondary component 26, first by specifying a category from a first listing of options provided on the first page of the menu (as shown, a percussion track 24), then by selecting a particular percussion track (as shown, a tambourine track).

In some preferred embodiments, where the telecommunication devices of one or more audience members are in communication with the CSPS so that the microphone and/or video inputting functions on the telecommunications device can be used in conjunction with the device's wireless communications with the CSPS (e.g., via a local network connection or via the Internet) to allow an audience member to render a performance that can be captured by the telecommunications device and transmitted to the CSPS. For example, in this way a telecommunication device able to capture the audio of an audience member singing (i.e., using the device as a microphone and signal transmitter of the digitized sound information to the CSPS) and transmit such singing to CSPS enabling a sound engineer, producer or performer, etc., to monitor the audience member's performance. In this way, the monitoring party can determine if such audience performer should be highlighted or spotlighted to the entire audience. Such monitoring can be in real time, through headphones, device speaker, external speaker(s), such as house sound system or the audience members telecommunication device sound generation means (e.g., via their speakers). In some embodiments, if such person is selected by the engineer, producer, performer, etc., or by an automated feature of the CSPS that might, for example randomly select audience members performing (singing, etc.), such performance by the audience member may then be merged by the CSPS with the primary component and played to the entire audience.

In some preferred embodiments, the CSPS incorporates an audience member location/tracking and spotlighting system that can move one or more spotlights to a position that will shine the spotlight's light beam on a particular location corresponding to the location of one or more specific telecommunication devices possessed by one or more audience members or to the known location of a seat or other attendance location that is associated in the CSPS with a ticket that is associated with a specific telecommunication device. This tracking function uses, for example, the location of the subject telecommunication device's(s') (determined by any of the means previously discussed) to move the spotlight to specified location. Systems that move equipment to point to a specified location are well known in the art, and include telescope pointing systems such as those used by Meade Instruments Corp. (See e.g. LX 90, www.meade.com/lx90), artillery targeting systems, etc. In some preferred embodiments, a spotlight is coupled with a mechanical pointing system that allows for computer control of the mechanical movement of spotlight so coupled to the mechanical pointing system where such control controls the pointing of the spotlight along at least the two axis of up/down and right/left in response to locational information provided to the computer control system that corresponds to the location of the subject telecommunications device in the possession of the subject "spotlighted" audience member or members.

In some preferred embodiments, the CSPS configured with the aforesaid audience member location/tracking and spotlighting system enables a user of the CSPS (e.g., a sound engineer, producer, non-audience performer, etc.) to train a spotlight on an audience member or group of audience members that are rendering a second component of interest. For example, if through the use of the aforementioned monitoring feature of the CSPS whereby an audience member is singing into the audience member's telecommunication device's microphone and such telecommunication device in communication with the CSPS is providing such audio performance to the CSPS, if a sound engineer, producer, non-audience performer, etc., monitoring the audience desires to spotlight the audience member's performance, the locational information regarding the location of the telecommunication device is provided to the CSPS by any of the means previously discussed, and such information is used by the audience member location/tracking and spotlighting system to move the spotlight to the location at which the telecommunication device is located, thereby "spotlighting" the audience member. In some preferred embodiments, the audience member's performance is also merged with the primary component and played through the venue sound system. In some preferred embodiments, the aforementioned merged performances are digitally and wirelessly sent to one or more audience members' telecommunication devices and played through the sound generation means of such devices.

It is to be understood that the telecommunication device capturing the audience member's performance need not be the telecommunication device possessed by the particular audience member of interest, if there is another nearby telecommunication device with similar functionality in communication with the CSPS. For example, a friend or other person proximate to the audience member of interest could hold up his or her telecommunication device to the subject audience member to sing into, and that device could be the one that is tracked for highlighting or spotlighting, etc.

In some preferred embodiments, similar to the aforementioned method and system of capturing an audio performance of an audience member of interest, the CSPS can capture a video performance of an audience member of interest by using the audience member's telecommunication device or another proximate to the subject audience member that is in communication with the CSPS. Thus the audience member of interest could be visually highlighted and such visual information could be used by the CSPS to broadcast the image and/or live captured video performance on one or more monitors in the venue. In some embodiments, using a combination of the aforementioned methods and systems, both audio and video components regarding an audience member's performance of a secondary component can be merged with the primary component and provided to other audience members via the venues sound system and monitoring system and/or via one or more audience members' telecommunication devices (e.g., via such devices' visual display and sound generation functionalities).

In step 30, the selected secondary component 26 is transmitted, via telecommunication device 18 and telecommunication network 32, to central site 34 (for example, a server on a wide-area network such as the Internet, a local-area network, a computer maintained at the site of the performance by primary producer 12, etc.), to which primary component 14 is also provided via a telecommunication network, a hard line or any other desired modality.

In step 40, primary component 14 and secondary component 26 are combined, for example, using an appropriate application maintained at central site 34 or by any other desired combining method, to produce the performance 42. The performance 42 may be streamed in real-time or reproduced in step 50, for example as CD 52 or a downloadable data file, which can then be provided to secondary producer 16 or others, either free of charge or upon the payment of a premium.

Composition 42 can also be provided to secondary producer 16 and/or other potential consumers prior to production or distribution of a recording of the performance 52, for example via Wi-Fi, blue-tooth transmission, near field communication means or another communication modality. This affords the recipient an opportunity to listen to the performance live in real-time or in substantially real time as it is being created. It also affords the recipient an opportunity to listen to the composition 42 and decide whether or not he wishes to acquire a recorded copy of the composition.

If desired, compilations of two or more compositions 42 produced according to the foregoing method or other methods described herein can be produced and distributed in similar manner. Such compilations can also include one or more such compositions and one or more recordings of primary components without further secondary components.

Additional features such as lyric or other text files, digital autographs, video or photographic files, additional audio files or the like, can also be combined with composition 42 in various ways. For example, additional instrumental, percussion, vocal or other audio parts or tracks can be added to composition 42 and recorded as a bonus recording, such as a "special dance mix" or other derivative work. Alternatively, a multimedia compilation can be produced including composition 42, together with one or more additional audio tracks, together with text, video or other files, and the compilation can then be recorded on an appropriate storage medium.

It is to be understood that the primary and secondary components may also be synchronously combined with the primary and/or secondary components and presented to audience members live via their telecommunication devices. For example, lyrics, music notation, and/or audience participation instructions can be streamed to audience members' telecommunication devices and displayed thereon in synchronicity with the music being played by a live music act (e.g., with the primary component), such as by scrolling the lyrics to coincide with a vocal part being performed by the live act. For example, where such lyrics display is alone or in combination with displayed applications, such as, for example, with the display of virtual instruments that the audience member can play along with the music act's performance. In some embodiments the lyrics comprise one or more parts that are meant to be performed by one or more audience members. In some preferred embodiments the producer, live act, sound engineer, etc., can use the CSPS to send to specified telecommunications devices in specified locations in the venue (or to other locations) certain lyrics and/or other instructions. In this way, for example, audience members on side of the venue can be provided with lyrics specified for that side of the audience to sing while other lyrics are provided to the other side of the audience to sing.

In some embodiments lyrics, music and other information is provided in sync with the primary component performance or in sync with another component of the performance by means of a person controlling the transmission and/or scrolling of such lyrics or music notation, or the providing of such synchronized instructions for display on audience members telecommunication devices. In some embodiments, such lyrics, music and/or instructions are synchronized via a synchronization track or a data instruction track synchronized with such a synchronization track. For example, it is common for live performances of music, pyrotechnic displays, show lighting effects, etc. to be synchronized to a sync track or other synchronization clocking means to which recorded artistic performances, such as music performance, as well as text, light effects, etc. may be synchronized. Numerous means of providing synchronization of displayed information, instructions, and/or mechanical or electronic events, etc., are well known in the art. In some embodiments any number of such means may be employed to synchronize the scrolling of lyrics and/or the presentation of other content on the audience members' telecommunication devices. Similarly, in some embodiments, control of any of the functions of such telecommunication devices previously discussed may also be synchronized with such a sync track or other means of synchronizing the effectuation of functionality(ies) on one or more audience members' telecommunication devices.

Figure 2:
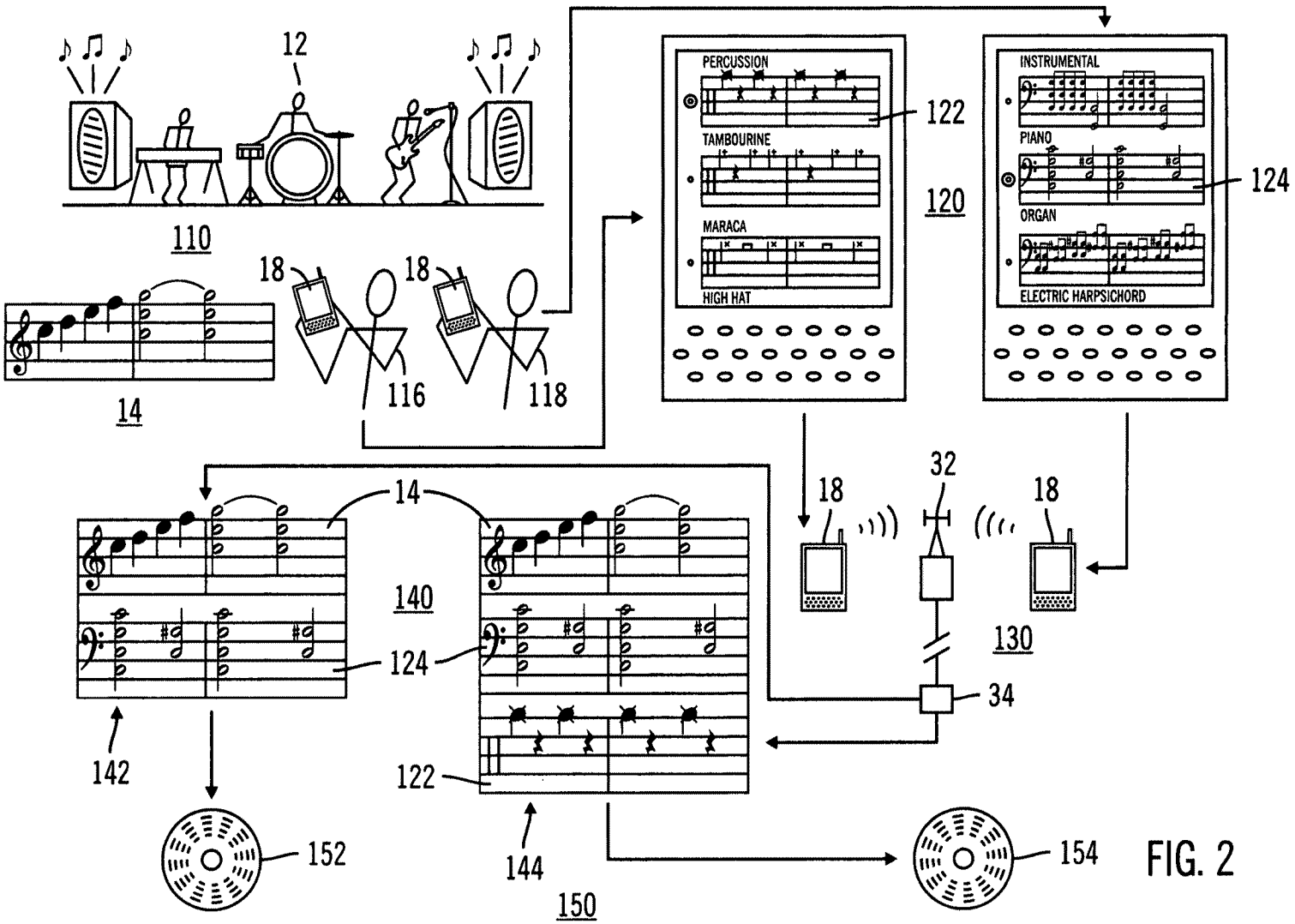
FIG. 2 is a diagram illustrating a second embodiment of a method according to the invention in which a plurality of secondary producers each select secondary components for combination with the primary component. Compositions are produced including some or all of the selected secondary components.

In FIG. 2, a plurality of secondary producers participate in the production of the composition. As with the previous embodiment, in step 110 primary producer 12 generates the primary component 14 of the composition. Secondary producers 116 and 118 view and/or listen to the performance of primary producer 12 while using telecommunication devices 18. In step 120, secondary producers 116 and 118 use telecommunication devices 18 to add their secondary components to the primary components via the CSPS. In some embodiments audience members select secondary components 122 and 124 (as shown, tambourine and organ tracks, respectively) after specifying a category from a first listing of options as with the previous embodiment. In some embodiments the these tracks can be one or more virtual instruments that the audience member has selected, which is/are played by the audience member, whereby the content produced by such audience member is combined with the primary component by the CSPS.

In step 130, the selected secondary components 122 and 124 are transmitted, via telecommunication device 18 and telecommunication network 32, to central site 34, to which primary component 14 is also provided. Next, in step 140, a plurality of compositions are produced by combining primary component 14 and one or more of secondary components 122 and 124. Thus, composition 142 is produced by combining primary component 14 with secondary component 124, while composition 144 is similarly produced by combining primary component 14 with secondary components 122 and 124. Compositions 142 and 144 can then be transmitted live or reproduced for later transmission, downloading, etc.

When a plurality of different compositions are produced, each composition can be made available to a different secondary producer. For example, if secondary producer 118 desires to obtain a copy of a composition including only primary component 14 and the secondary component he personally selected (e.g., secondary component 124), then a copy of composition 142 (e.g., CD 152 or by downloading the file) can be made available to him, free of charge or upon payment of a premium. Alternatively, if secondary producer 116 desires to obtain a copy of a composition including the primary component 14 and both secondary components 122 and 124, then a copy of composition 144 (e.g., CD 154 or file) can be made available to him. It is to be understood that in some embodiments a copy of one or more compositions containing one or more secondary components generated by the a user himself or herself using one or more virtual instruments can be made available to the secondary producer.

In order to ensure that secondary producers, such as participating audience members, are afforded an opportunity to obtain a copy of the composition of his choice, in some embodiments, each secondary component can be associated with the secondary producer who selected it in particular embodiments. This can be accomplished, for example, by one or more appropriate software applications to provide to the secondary producer as part of the application used for selection of the secondary component, a local means of combining the primary and secondary components into a composition that is stored on the secondary producer's (e.g., audience member's) telecommunication device.

In some embodiments, a tracking code that is associated with the audience member's telecommunication device is associated with the secondary component and/or the resultant composition including one or more secondary components the secondary producer has selected or produced, or by any other desired tracking procedure. In some embodiments the CSPS can access such code to uniquely associate such secondary components with a particular telecommunications device for further use in association with various embodiments of the CSPS.

As shown in FIGS. 1 and 2, each secondary producer selects one secondary component for combination with the primary component to produce a composition according to the invention. Secondary producers are not limited to selecting a single secondary component, however; in alternative embodiments, a secondary producer is enabled to select two or more secondary components for combination with the primary component. The secondary components so selected can be chosen from the same category (e.g., percussion tracks), or from different categories (e.g., a percussion track and an instrumental track).

Secondary components are not limited to percussion, instrumental or vocal tracks, but can include any sequence of sounds in any desired combination. Sounds effects such as explosions, mechanical or industrial sounds, samples, audio loops, or the like can also be employed as secondary components.

As illustrated, the secondary components made available to the secondary producers are pre-recorded tracks that the secondary producer need only specify for combination with the primary component. Alternatively, an appropriate application, such as Garage Band™ or the like, including without limitation applications for virtual instruments playable on a touch screen, such as a virtual piano, virtual drums, virtual guitars, etc. can be employed by a secondary producer, enabling him to actually compose an original secondary component for combination with the primary component. In such embodiments, telecommunication device 18 includes or is in communication with a keyboard, touchscreen or other input device that enables the secondary producer to play or otherwise compose a part or track including one or more instrumental, percussion and/or other elements, which can be repeating or non-repeating as desired and/or as enabled by the particular application provided to the secondary producer. The application, such as a virtual piano, etc., can be provided to the secondary producer via the telecommunication device 18, or can be provided by the secondary producer himself, such as when such application is resident on the user's device. In some embodiments, the CSPS detects which, if any, applications are on the secondary producer's (e.g. the audience member's) telecommunications device to provide appropriate options enabling the audience member to play along with the primary component. For example, an audience member X's telecommunication device in communication with the CSPS might provide information to the CSPS after appropriate digital query of the telecommunication device's applications complement, that the device has a virtual conga drum application installed on the telecommunications device. If the show producer intends that one or more songs planned to be played at a concert are to include the possibility of audience participation by the playing of a virtual conga drum on the audience members' telecommunications devices, and the CSPS is configured to effectuate such integration of such playing of such virtual conga drum secondary components into the performance, then, in some embodiments, the CSPS will cause the telecommunications device to activate and display the virtual conga drum for use at the appropriate time during the concert. In some embodiments, for example, where a virtual instrument application, like a virtual conga drum application, that the show producer wants an audience member to be able to play to provide the secondary component in a song to be performed during the concert is not resident on the secondary producer's telecommunication device, an advisory notice to the telecommunication device's possessor is displayed to the effect of asking the possessor if the party would like to download the virtual instrument, such as virtual conga drum of use by the audience member in the concert to play along with the concert music performer (s).

Various means of remote activation of applications on telecommunication devices is well known in the art, such as the activation of an application displaying Wi-Fi connection options when a telecommunications device has received a Wi-Fi signal.

Figure 3:
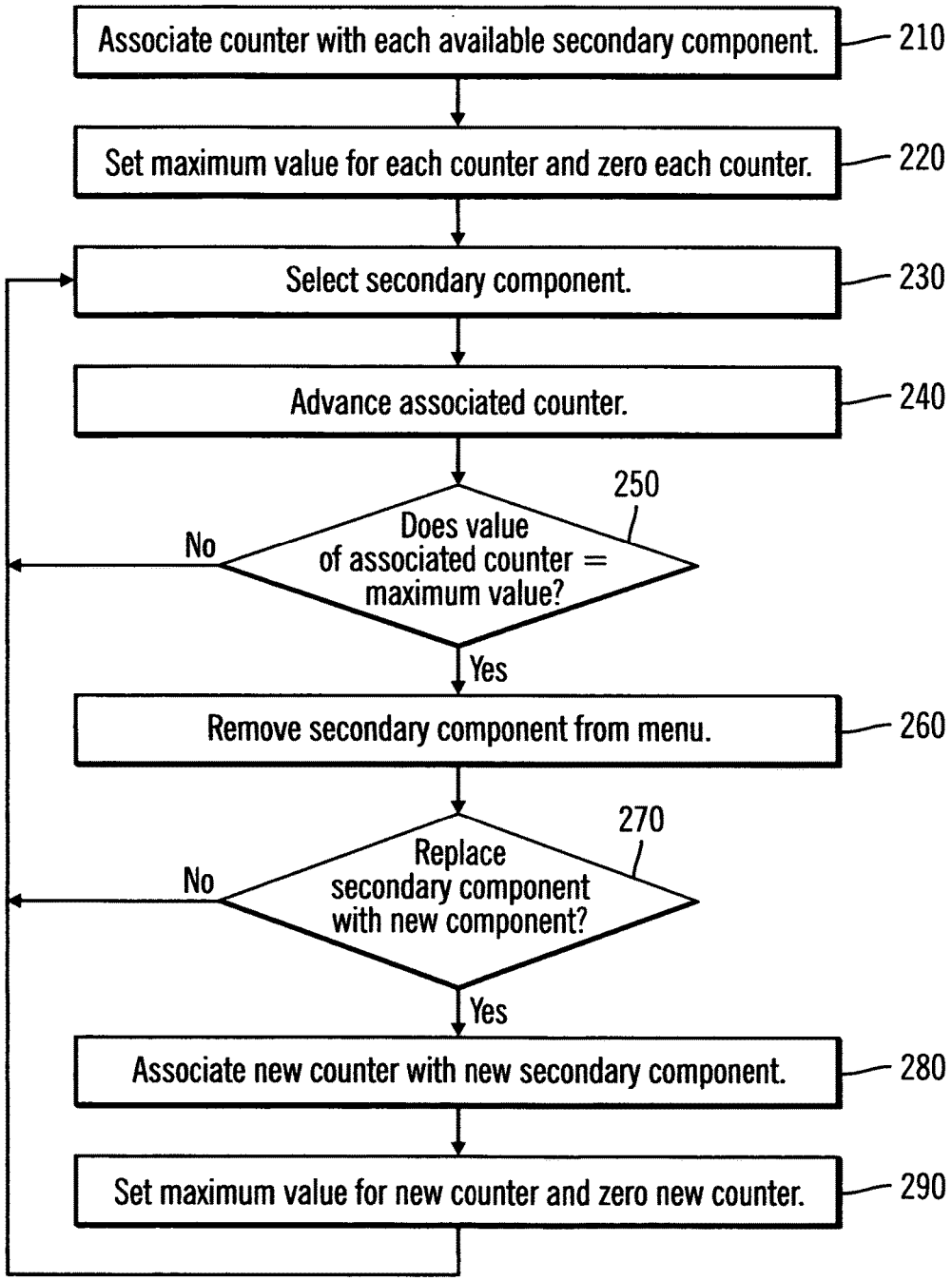
FIG. 3 is a flowchart of a "dynamic menu" for use in particular embodiments of the inventive method, which provides for withdrawal of a secondary component from a menu when that component has been selected a specified number of times, and optionally for replacement of that component on the menu with a new component.

When a plurality of secondary producers participate in the production of a composition, a large number of them may select the same secondary component for combination with the primary component. It may be desirable to limit the number of times a particular secondary component can be selected among the population of audience members, in order to prevent an artistically excessive number of persons providing the secondary repetition. For example, a primary producer may wish to limit the number of tambourine tracks, tambourine virtual instruments, or tambourine loops that are combined with the primary component to produce a composition. Thus, in certain particular embodiments of the inventive method ("dynamic menu" embodiments), the CSPS limits the number of times a particular secondary component can be selected, and modifies the menu of choices provided to secondary producers when a particular secondary component is selected a specified number of times. FIG. 3 illustrates such an application. In step 210, a counter is associated with a secondary component the number of selections of which it is desired to be limited. When it is desired to limit the number of times a plurality of secondary components can be selected, each secondary component available for limitation is assigned a separate counter. A maximum value for each counter is set, and each counter is then zeroed (step 220).

When a secondary producer selects a secondary component to which a counter has been associated (step 230), the associated counter is advanced (step 240). It is then determined whether the current value of the counter equals the assigned maximum value (step 250). If the current value is less than the maximum value, then the secondary component remains on the menu. If the current value equals the maximum value, then the associated secondary component (the "maximized secondary component") is removed from the menu (step 260).

In particular embodiments of the inventive method, subsequent choices of secondary component are made from the original menu from which the maximized secondary component has been removed. In other particular embodiments (step 270) replacement of the maximized secondary component with a new secondary component is authorized. A new counter is then associated with the new secondary component (step 280). A maximum value is specified for the new counter, and the new counter is zeroed (step 290). The revised menu is then made available to subsequent secondary producers for selection of additional secondary components.

In some embodiments the CSPS can limit menu options based on the location of the audience members instead of or in addition to limitations based on the number of the particular option selected. In this way, for example, a concert producer using the CSPS can effectuate a desired number or balance of numbers of audience virtual instrument players at particular locations in the audience.

It is to be understood that an audience member's participation in the performance by creating a secondary component input by playing a tambourine part by tapping on a virtual tambourine instantiated on the audience members' telecommunication device, for example, can be monitored by the user in real time through headphones (such as might be attached to the telecommunication device) with or without the primary component mixed in, or via the telecommunication device's speakers, or an external speaker connected to the device by wired or wireless means. In some preferred embodiments the speakers of all or part of the audience are used to monitor one audience member performing. Thus, for example, a producer, sound engineer, performer, etc., who is monitoring audience members' participation (i.e., monitoring the generation of the secondary components produced by audience members), might detect an audience member playing a virtual instrument well or in an interesting way that might be appropriate to make a part of the show. Using the locational means described above to find the subject audience member's telecommunication device's location in audience, and the audience member location/tracking and spotlighting system described above, the producer, sound engineer, performer, etc., could spotlight the person. Also as previously discussed, in some embodiments, the person's performance could also be broadcast on the venue sound system, and/or on some or all of the audience member's devices.

In some preferred embodiments, the primary component, or just the performer's independent component, is broadcast to the audience device speakers. In this way special effects like a sonic wave (similar to the audience "wave") could be achieved as audience device speakers are engaged/disengaged for monitoring in a circular pattern around the room (perhaps you could explain it in a more enabled way). Similarly, audience location-based sound generation using the sound generation means of audience telecommunication devices can be effectuated by performers interacting with the CSPS, which, in turn is in communication with the subject audience members' telecommunications devices and is enabled to use such telecommunication devices sound generation means to produce the sound desired by the performer (e.g., by using the subject telecommunication devices speakers, etc.). For example the audio signal from a guitar player on stage could be routed to such selected telecommunications devices for reproduction at and by such devices. Many novel aesthetic effects can be accomplished by means of selectively using remotely located audience member's sound generating devices, particularly if such devices can receive a signal through the CSPS corresponding to a desired sound, which then can be played through the selected telecommunication devices in the audience. For example an interesting "call and response" motif can be established by a guitar player who plays a musical phrase or riff that is routed (e.g., by a sound engineer or the musician his or herself) to the stage sound system, and then the guitar player plays the same riff but this time the signal is routed (e.g., by a sound engineer or the musician his or herself) via the CSPS to 100 audience members' telecommunication devices at the extreme far end of the venue away from the stage. Similarly, a visual image captured by a video camera of a performer can be made (e.g., by a director, producer or the performer his or herself) to appear on monitors next to the stage, then the image can be made to "jump" to the screens of one or more audience members' telecommunication devices through the CSPS. In some embodiments where the performer is first visible on stage to the audience directly, and then obscured from the audience from direct on-stage viewing by an obscuring means, but is nevertheless captured by video means behind or otherwise despite such obscuring means and such video capture means transmits the image of such performer to the displays of one or more audience members' telecommunication devices, the performer could produce the effect of appearing to "jump" from the stage to one or more individual audience members' telecommunication devices' display screens. In some preferred embodiments, this feature of the CSPS enabling a performer to appear on the display or displays of one or more specified telecommunication devices in the possession of one or more participating audience members, can provide to a performer the ability to personalize a performance to a single selected audience member or group of selected audience members.

In some embodiments the audience device speaker usage may be coordinated with the audience phone "pixel" feature previously discussed to produce a large audience-generated display of the performer with associated sound.

In some embodiments, the producer can provide devices, such as powered speaker units for the audience to wear, for example, that might provide a more powerful sound generation means than the audience members' telecommunication devices' can provide.

In some embodiments, CSPS interfaces and communicates with clothing comprising or incorporating wearable computing devices, such as ponchos, or body suits on which are disposed one or more flexible displays, whereby such display(s) is(are) in communication with one or more processors and such processors are in wireless communication with the CSPS so that display information associated with the primary component, the secondary component or both can be displayed via such display(s). It is to be understood that such devices should be considered to be "telecommunication devices" as that term is used in this disclosure. Similarly, such types of garments, or persons wearing such garments, may, in some embodiments, also be configured with sound generation means in communication with the CSPS, and such garments and sound generation means can be used in coordinated association with the CSPS to generate visual and audio content comprising primary and/or secondary components. In some embodiments, such visual and/or audio content can be selectively displayed and/or played via such devices in communication with the CSPS on the basis of the location of such telecommunication devices.

Figure 4:
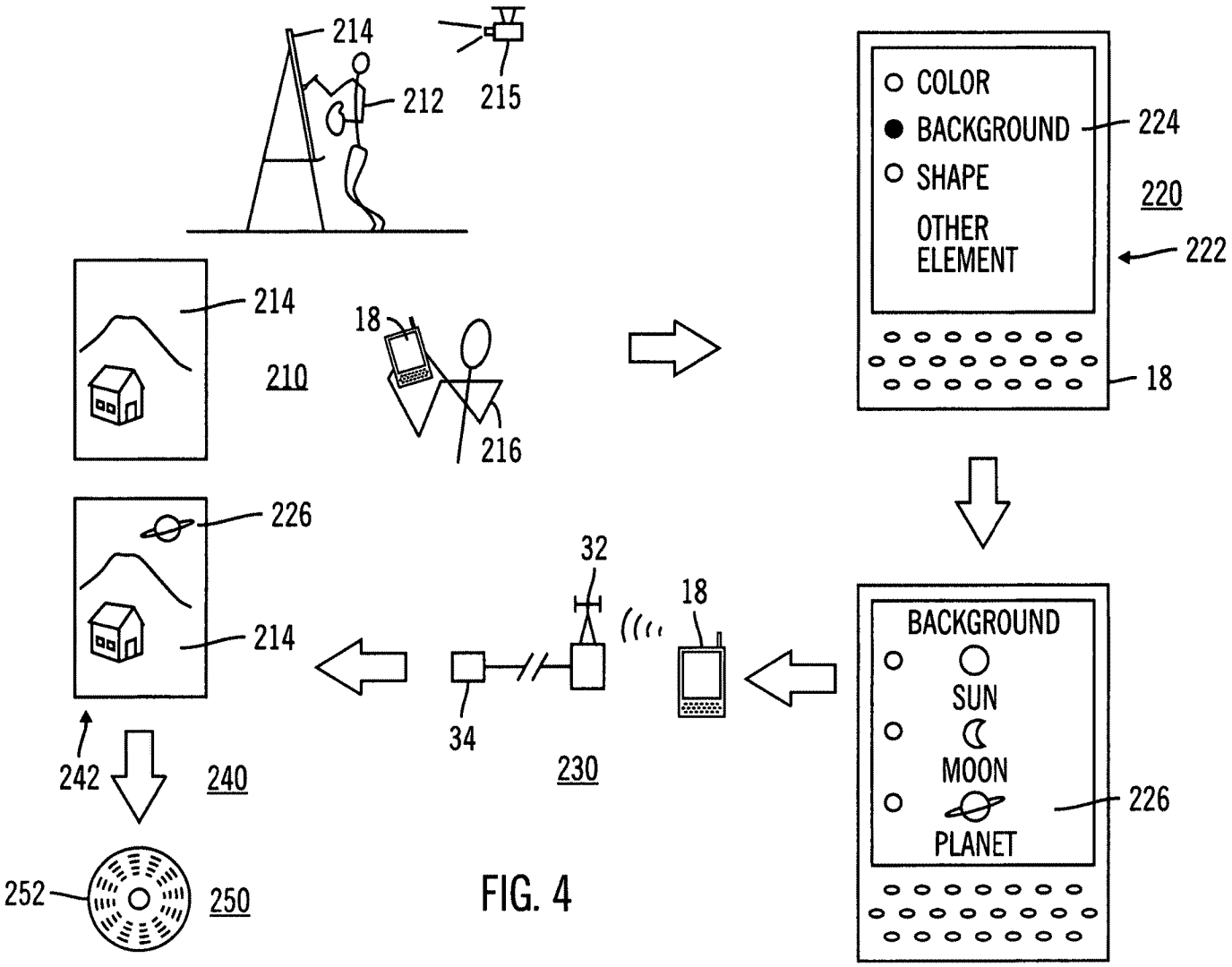
FIG. 4 is a diagram illustrating an alternative embodiment of a method according to the invention in which a visual artwork (a painting) is produced. The primary producer, the artist, produces a painting, while the secondary producer, an audience member, selects an element for inclusion in the background of the background of the painting. The two components are combined, and a recorded image of the composition is produced.

A number of the preceding embodiments have been directed to musical or other audio compositions. It is to be understood that such embodiments should not be viewed as limiting. Alternative embodiments, for example, afford viewers the opportunity to participate in the creation of graphic or other visual compositions, such as paintings, drawings, films, videos, photographs, computer-generated graphic works, and the like. Turning to FIG. 4, in step 210 a painter serves as primary producer 212, and generates the primary component 214 of a composition, here a painting, an image of which is captured by camera 215 and provided to a viewing screen or other appropriate display device (not shown). Secondary producer 216 views the painter and the image of the painting from an audience. In step 220, secondary producer 16 accesses a first page of a menu 222 provided to telecommunication device 18, and selects a secondary component 226 in a manner similar to the preceding embodiments, first by specifying a category from a first listing of options provided on the first page of the menu (as shown, a background 224), then by selecting a particular background element (as shown, a planet).

In step 230, the selected secondary component 226 is transmitted, via telecommunication device 18 and telecommunication network 32, to central site 34. An image of the primary component 214 is also provided to central site 34 via a telecommunication network, a hard line or any other desired modality.

In step 240, the image of primary component 214 and the selected secondary component 226 are combined to produce composition 242, as shown a painting with a planet added to its background. Composition 242 is then reproduced in step 250, for example as a DVD 252, which can then be provided to secondary producer 216 or others as above. Additional features can also be combined with the primary and secondary components to produce a finished composition, such as the painter's autograph. Additional features such as text files, audio files, additional video or photographic files, and the like, can also be added to DVD 252 as desired by the primary producer, as requested by the secondary producer, etc., in a manner similar to the preceding embodiments.

In additional very specific embodiments, secondary producer 216 is enabled to actually generate his or her own secondary component(s) 226 for combination with primary component 214 to produce composition 242. In such embodiments, secondary producer 216 is equipped with a telecommunication device 18 having a touch-screen or other similar input device, and is provided with an application that enables secondary producer 216 to produce graphical images by touching the touch-screen. For example, a typical application enables secondary producer 216 to produce "finger paintings" by touching the touch-screen of his or her telecommunication device. These finger paintings are then transmitted in a manner similar to the preceding embodiment to central site 34 and combined as described above.

In some embodiments, for example a participant can add his or her graphical, photographical or videographical creation to one or more of the display screens used at the venue. In some embodiments, the screens may be above the audience and people can create moving images, such as virtual "comets" or other ephemeral images, in real time such as by swiping a finger across a touch screen on a telecommunication device with a drawing or painting application instantiated that is in communication with the CSPS whereby such motion produces a graphical paint brush stroke or the like. In some embodiments the number of users allowed to participate in such graphical, photographical or videographical collaborations via the CSPS, and/or the duration of such allowed participation, may also be controlled by the CSPS.

In addition to enabling the production of live, recorded or otherwise reproduced images, alternative embodiments of the inventive method enable primary producer, such as the foregoing painter, to select among secondary components submitted by secondary producers, and to incorporate the selected components into the composition. Thus, the painter would be provided with a list of secondary components, such as background elements, selected by one or more audience member, and could then select one or more of the elements and paint the element into the painting directly, rather than waiting for images of the painting and the element to be digitally or otherwise combined.

Compositions including both audio and video elements can also be produced according to further alternative embodiments of methods according to the invention. Appropriate menus are provided to one or more secondary producers as described herein, enabling selection of one or more secondary components in the desired media for combination with primary components as described above.

In addition to enabling production of participatory compositions including primary and secondary components contributed by performers and their audiences, the invention also enables viewers of a performance to participate in the process of creating the visual environment in which a performance is perceived. Thus, instead of specifying a secondary component of a performance that is combined with a primary component to produce a finished composition that can be created or performed live and which in some embodiments can be recorded, a viewer (corresponding to the secondary producer) views a performance by a primary producer such as a musical group, but selects between viewing the performance as it is actually performed in physical space, and viewing an image of the performance combined with a secondary performance component, such as a background still or moving image, a textual element or other alphanumeric sequence, or one or more other components. In some embodiments, the performance is combined with Virtual World components.

Figure 5:
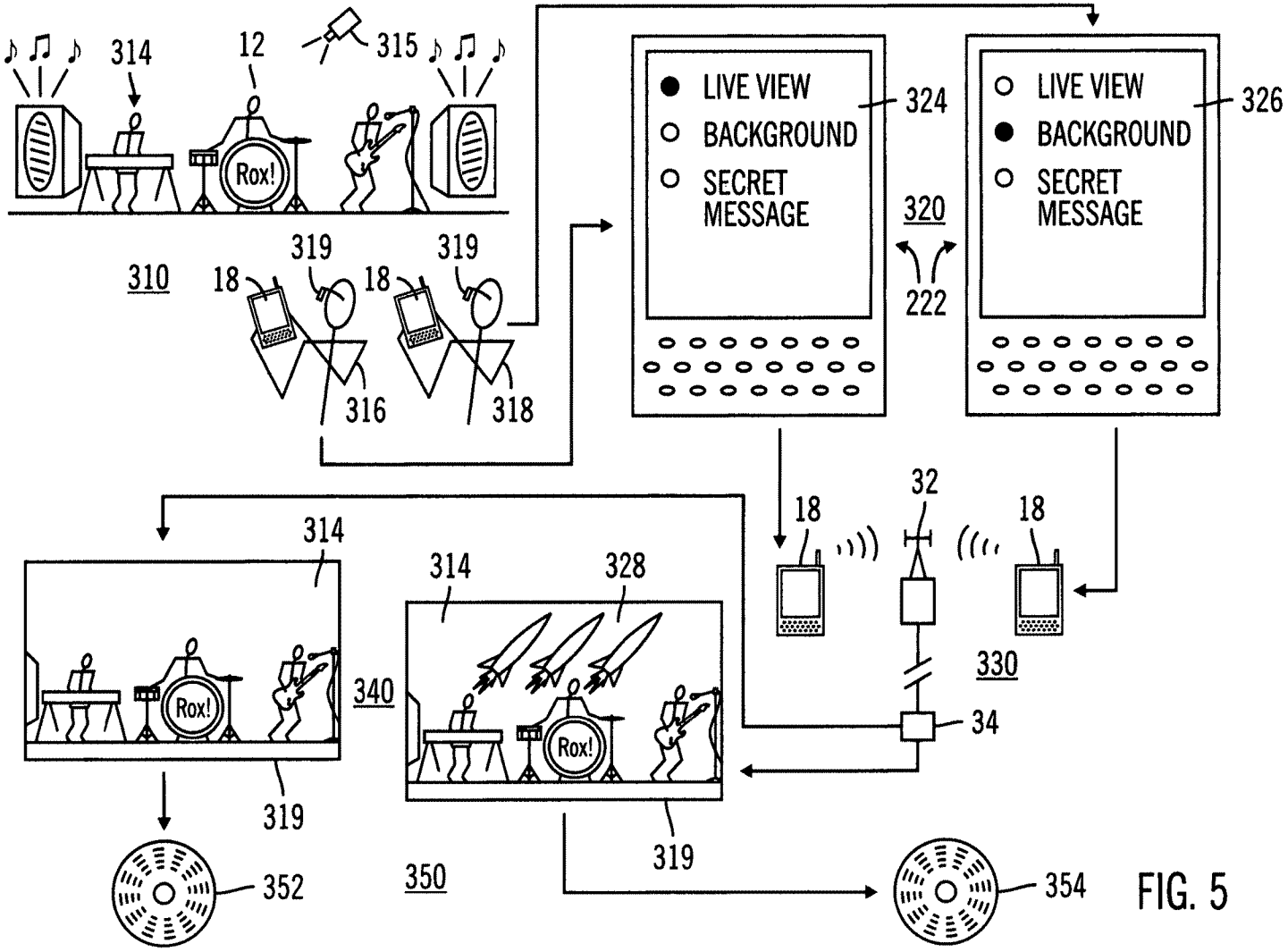
FIG. 5 is a diagram illustrating another embodiment of a method according to the invention in which a performance is viewed by members of an audience equipped with a viewing device and a telecommunication device. The viewers are enabled to view the performance unmodified and as performed, or alternatively in combination with a secondary performance component such as a computer-generated background.

Thus, referring to FIG. 5, a plurality of viewers function in a manner analogous to the secondary producers of FIG. 2, but specify the nature of at least a portion of the performance that they will view. In step 310 primary producer 12 generates a primary performance component 314, an image of which is captured by camera 215 and provided to central site 34. Viewers 316 and 318 view the primary performance component 314 from an audience. The viewers are equipped with telecommunication devices 18, and also with visors 319, in particular visors that are in communication with telecommunication devices 18, that are adapted to receive and display projected images. Non-limiting examples of visors 319 include the MyVu™ visor device which is used in conjunction with telecommunication devices such as the I-Pod®. Other similar devices can be used if desired, including without limitation the device known as Google Glass™. In step 320, viewers 316 and 318 are provided with a menu 222 displayed via telecommunication devices 18. The viewers are afforded the option to specify the performance they will view. A viewer may select the "Live View" option 324, for example, to specify that he desires to view the primary performance component 314 as actually performed, without further embellishment. Alternatively, the viewer may select the "Background" option 326 (as illustrated), the "Secret Message!" option (e.g., a message to a specific viewer to come up to the stage, together with a password allowing stage access, or a message notifying the viewer that he has won a prize), or other options that may be provided by the primary performance producer or another party associated with the performance. Selection of such alternative options results in the generation of a secondary performance component 328. If desired, additional menu pages can be provided to afford a viewer a wider selection of background displays or other secondary performance components.

In step 330, the various viewer selections from step 320 are transmitted, via telecommunication device 18 and telecommunication network 32, to central site 34, to which the image of primary component 314 captured by camera 315 is also provided. Next, in step 340, viewers 316 and 318 are enabled to view the performance, either as performed without further modification, or in combination with a selected secondary performance component. Thus, viewer 316 views the primary performance component 314 using visor 319 (or, alternatively, with his naked eyes). Viewer 318 views the primary performance component 314 combined, by use of an appropriate computer application or other means, with the secondary performance component 326, using visor 319. Thus, as illustrated, viewer 318 views the band's performance against a background display of rockets flying through space.

In some embodiments representations of one or more the primary component performers (such as non-audience performers) and/or representations of one or more audience members are avatars in a Virtual World environment, and such avatars and such Virtual World environment can be merged with one or more the primary components and/or one or more secondary components for display on one or more audience members' telecommunication devices. For example, in some embodiments, where a live performer's movements are tracked to control the movements of an avatar in a Virtual World environment, such avatar movements and the Virtual World environment are, in turn, provided via the CSPS in communication with the application(s) generating such Virtual World environment and avatar movements to audience members' telecommunication devices for display thereupon.

In some embodiments, the use of Virtual World technology in association with the CSPS can be used to provide to an augmented reality experience to audience members. In some such embodiments, audience members' telecommunication devices can provide and/or combine one or more perceptible Virtual World environment components of a performance that are not in the live performance with a live (e.g., on stage) performance. For example, such Virtual World environment components can be viewed by audience members using a telecommunications device that employs a head's up display that would allow the audience to see, and in some embodiments, also hear, both the live performers (e.g., on stage) and virtual performers at the same time. In some embodiments, the CSPS combines an audiovisual data stream corresponding to the live performance and an audiovisual data stream corresponding to a performance in a Virtual World can be provided to the audience members' telecommunication devices to create the augmented reality experience. Methods of combining two or more audiovisual data streams are well known in the art. In some other embodiments, where the audience members' telecommunication device allows for normal direct visual and auditory sensing of the live (e.g.; onstage) portion of the performance directly (e.g., outside or through a telecommunications device, such as) and perception of one or more audiovisual data stream corresponding to one or more Virtual World environment audiovisual information streams on one or more displays and, in some embodiments, via incorporated sound generation means, the combination of the live performance and the Virtual World environment audiovisual stream being provided on the telecommunication device is accomplished directly by the audience member his or herself.

In some preferred embodiments, the use of avatars by performers in association with the CSPS can provide performers with the ability to appear to the audience as the avatar that the performer desires. For example, in some preferred embodiments, where a performer's motions are tracked by a motion tracking application in association with the CSPS, and information generated by such motions tracked by the motion tracking application is used to animate an avatar, the resulting data regarding the animated movements of the avatar is provided to the CSPS and can be displayed on telecommunication devices in the possession of participating audience members, display monitors on stage, on other venue display monitors, and/or on other displays, such as those associated with telecommunication devices or other computers not physically in the venue.

The performances transmitted to telecommunication devices configured with a "heads-up" display, such as visors 319 can further (step 350) be recorded, for example as DVD's 352 and 354 or as other digital files, and made available to viewers 316, 318 and/or other potential purchasers.

Primary performance component 314, according to the foregoing embodiment, is viewable and/or recorded from a single viewpoint, camera 315. Alternatively, primary performance component 314 can be viewable and/or recorded from a plurality of different viewpoints, and by appropriate software the various viewpoints can be integrated into a single recording.

Figure 6:
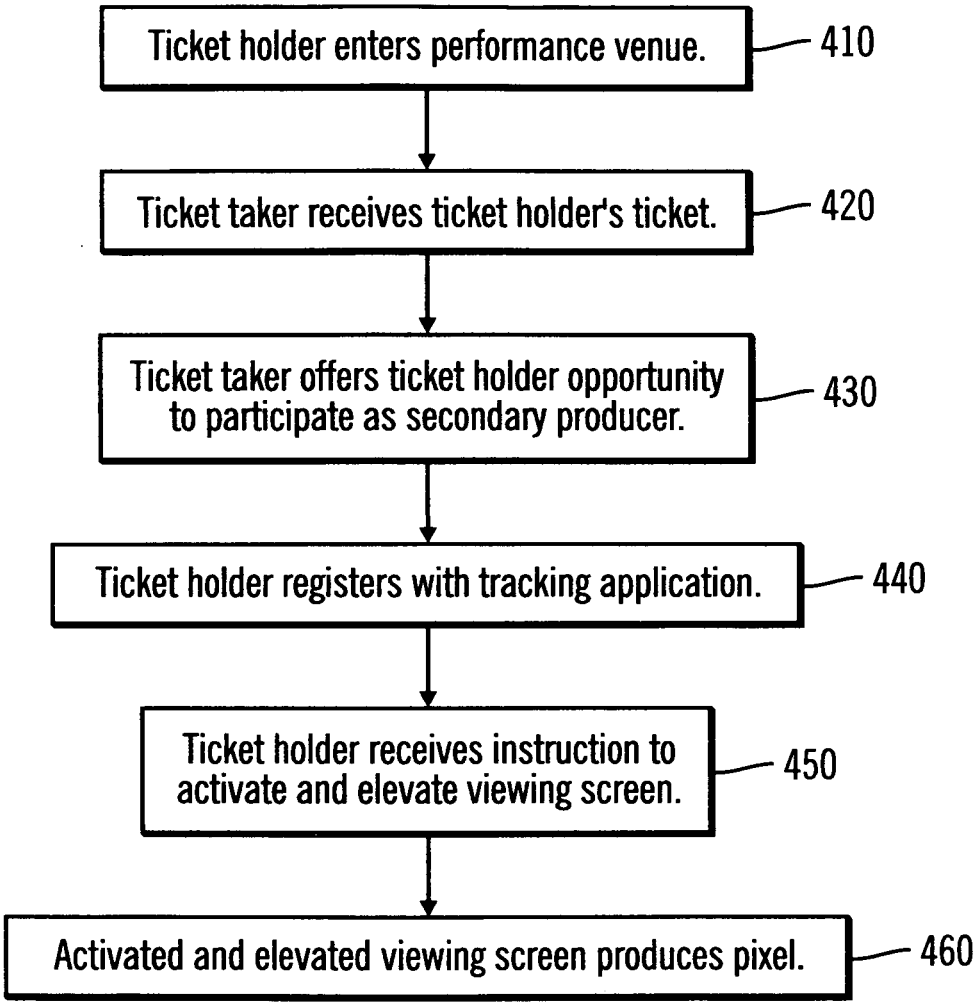
FIGS. 6-9 are flow charts illustrating additional methods according to the invention for providing audience members with instructions enabling them to participate in the production of visual displays, in which telecommunication devices held by audience members produce pixels that combine to form the visual displays.

Audience members have been known to spontaneously demonstrate approval of, for example, a performance by holding aloft lit cigarette lighters. Further embodiments of the invention make use of this sentiment and enable audience members at a performance to create a visual display in conjunction with the performance of the musical composition, which can then be recorded for downloading, purchase, etc. In such embodiments, audience members, functioning as secondary producers in a manner similar to that described above, employ their telecommunication devices to receive instructions directing them to elevate their activated devices, for example, at particular times during a performance of the song, when specific lyrics are performed, or specific instructions appear on the audience members' telecommunication devices. When the secondary producers do so, a pattern of pixels is produced, with an activated and illuminated viewing screen of each activated telecommunication device functioning as a pixel. The pattern of pixels so produced can form an image or series of images. The image(s) so produced can then be recorded as part of a recording of the performance, and the recording so produced can be accessed, downloaded, and sold as described herein. Secondary producers (e.g., audience members) can be provided with content, computer applications, code, and instructions, such as instructions to use their activated telecommunication devices during a performance, in any number of ways. Turning now to FIG. 6, a first method for providing instructions to secondary producers is illustrated. In this exemplary method, a ticket holder for a performance enters a venue at which a performance is to be given (step 410), at which venue the ticket holder will become a potential secondary producer. At the entrance to the venue, a human or automated ticket taker validates or receives the ticket holder's ticket (step 420). In some embodiments, such as where near field communication technology is used to check or validate an electronic ticket in a telecommunications device possessed by the ticket holder, the process of "taking the ticket" is accomplished by automated or electronic means. It is, therefore, to be understood that the "ticket taker" may therefore be a human being, a computer program, an automated ticket validation system, or another computerized functionality, combination of computerized functionalities, or combination of computerized functionalities and human means. In some embodiments, the ticket taker then offers the ticket holder an opportunity to participate as a secondary producer (step 430), for example, to receive instructions on the ticket holder's telecommunication device in his or her possession pertaining to when and in what manner to activate his or her telecommunication device to participate in the performance, such as by becoming a part of one or more audience-generated displays during the performance (e.g., to effectuate the use of the ticket holder's telecommunication device as a "pixel" in such an audience-generated display. Thus, for example, in some embodiments, such as, for example, where the ticket taker is an automated system (which in some embodiments is part of the CSPS) in communication with the ticket holder's telecommunication device, the ticket holder is offered, via a notice displayed on the ticket holder's telecommunication device, an opportunity to participate in the performance, e.g., in audience generated displays or otherwise as a secondary producer, etc.

In some embodiments, if the ticket holder accepts the offer to become a participating secondary producer, the ticket holder and/or the ticket holder's telecommunication device in communication with the CSPS registers with a CSPS application that tracks the ticket holder and/or the ticket holder's telecommunication device so registering, to enable such ticket holder to act as a participating secondary producer (step 440) in the production of the one or more compositions or other performances, such as, for example the production of an audience-generated display. Registration can include, for example, provision of an identifier for the audience member's telecommunication device having an activatable viewing screen, together with the ticket holder's seat number or other venue location where such audience member is likely to be during the performance (e.g., in a designated seat or in an area designated for general seating). Once the ticket holder and/or the ticket holder's telecommunication device has registered with the CSPS, the ticket holder becomes a potential secondary producer.

In some embodiments, after the ticket holder's telecommunication device has registered with the CSPS, content, programs, applications, and/or other information are downloaded or otherwise wirelessly made available to the ticket holder's telecommunication device by the CSPS. Such information, in some embodiments, may include, without limitation, virtual instruments, lyrics, Virtual World environments, gaming software, and software enabling CSPS control over the telecommunications device's functionality, etc., for the purpose of enabling the telecommunication device and its possessor to send and/or receive content, instructions, applications, control data etc., in communication with the CSPS, and thereby enable the possessor to become a secondary producer in a performance or other composition.

In some embodiments, where the telecommunication device is in communication with the CSPS, and the telecommunication device is thereby enabled to act as a "pixel" in an audience display, at a desired time during the performance, an appropriate participation instruction is then provided to the ticket holder in possession of the telecommunication device so enabled. For example, such instruction may be provided via an appropriate software application in the CSPS, instructing the telecommunication device possessor to activate and display (e.g., elevate) the viewing screen of his or her telecommunication device at his or her ticketed location (step 450), or to refrain from doing so. In some embodiments, the signal generated by the telecommunication device instructing the ticket holder/possessor of the telecommunication device to raise the telecommunication device can be visual, sonic or haptic. In some embodiments, the ticket holder's telecommunication device has been previously provided, by the CSPS, with appropriate display information for the telecommunication device's display to act as a pixel in the audience-generated display at the location at which the ticket holder is expected to be based on the seat or other attendance location specified in the ticket holder's ticket. Specifically the assumed location of the telecommunication device (i.e., at a particular seat or other location corresponding to that identified in the ticket holder's ticket) is used by the CSPS to provide appropriate content to that telecommunication device for its assumed location in the audience-generated display. In some embodiments, the display information enabling the telecommunication device to act as a pixel in an audience-generated display, is provided to the telecommunications device based on information regarding the location of the telecommunication device that is communicated by the device to the CSPS, using GPS, radio signal triangulation or other telecommunication device location means known in the art. An activated and elevated viewing screen produces a pixel (step 460) of an image in an audience-generated display or other multi-person generated composite display. Thus, for example, each audience member so activating and elevating the audience member's telecommunication device (or simply elevating the display of a telecommunications device automatically activated by the CSPS) configured to display information, such as an image, color, a video, etc., corresponding to a audience- or other multiperson-generated display pixel acts as a participant (i.e., secondary producer) of a performance, specifically, a participant in the production of a pattern comprising an audience-generated, or multiperson-generated, display. The pattern so produced can be varied by providing further instructions to each such secondary producer in the described manner. A sequence of patterns can thus be produced, simulating, for example, a moving image, or producing a plurality of different images.

Such coordinated audience-generated displays can be particularly useful in performance situations where multiperson performance coordination is desired. For example, in halftime shows, parades, theatrical performances, dance routines, religious services, etc.

Figure 7:
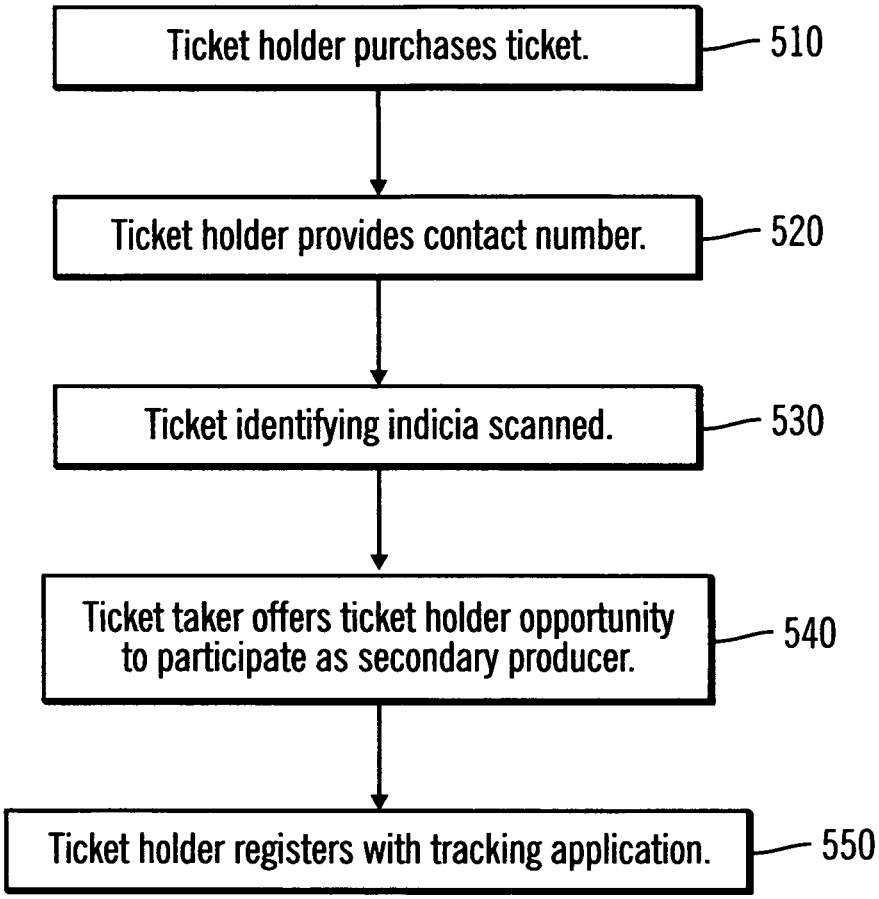

Registration information can also be provided automatically by use of the ticket holder's ticket itself. Thus, in FIG. 7, the ticket holder purchases a ticket (step 510) on-line, telephonically, in person, or by any other procedure, and provides a contact or registration number or some other identifying indicia to the CSPS at the time of purchase (step 520). In some embodiments, the ticket so purchased includes identifying indicia, for example a barcode such as a Universal Product Code (UPC) or QR Code, that associate the ticket with the specific seat number or other venue location for which the ticket is purchased, as well as the ticket holder's contact number. Upon arrival at the performance venue, the identifying indicia of the ticket holder's ticket are scanned or otherwise read (step 530), for example by a human ticket taker scanning a UPC or QR Code printed on the ticket or by an automated means, such as by the validation or "taking of the ticket" by an automated scanning or other automated means. In some embodiments where the "ticket" is stored in a telecommunications device, it can be validated, redeemed, or "taken", at the venue via an electronic system using near field communication technology to communicate with the telecommunication device. The ticket taker then offers the ticket holder an opportunity to participate as a secondary producer (step 540) as previously discussed. If the ticket holder accepts the offer, the information associated with the ticket holder's ticket, as scanned, for example, in step 530, is provided to an application that tracks each participating ticket holder, in a manner similar to that discussed in the preceding embodiment (step 550), and the ticket holder and/or the ticket holder's telecommunication device in his or her possession is(are) registered in the CSPS as a participating secondary producer. Once the ticket holder and/or the ticket holder's telecommunication device in his or her possession has been registered in the CSPS, he or she becomes a potential secondary producer, and instructions, content, programs, applications, etc., are then provided to the ticket holder and/or the ticket holder's telecommunication device as discussed above. As previously indicated, in some embodiments, such registration may be associated with the presentation of CSPS authorization choices and the providing of, or denying of, such authorizations, which in turn, will determine what content, applications, instructions, etc., will be provided to the telecommunication device and what functions of the telecommunication device will be controllable by the CSPS, before, during, and/or after the performance.

Many of the foregoing embodiments make use of physical tickets in the possession of a ticket holder. Some embodiments make use of "virtual tickets" which are provided to a ticket holder's telecommunication device and displayed or scanned at an entrance to the performance venue via such viewing screen. For example, a virtual ticket including a barcode, such as a UPC or QR Code, is provided to the ticket holder's telecommunication device. In some embodiments, the barcode associates the ticket with a seat location and ticket holder information, as mentioned above. In some embodiments the barcode contains information that associates the seat or other venue attendance location authorization (e.g., festival seating, dancefloor, etc.) with the telecommunication device, either directly such as by using one or more of the telecommunication's device identification numbers, codes, etc., or indirectly through the device's owner's account number, etc.

Figure 8:
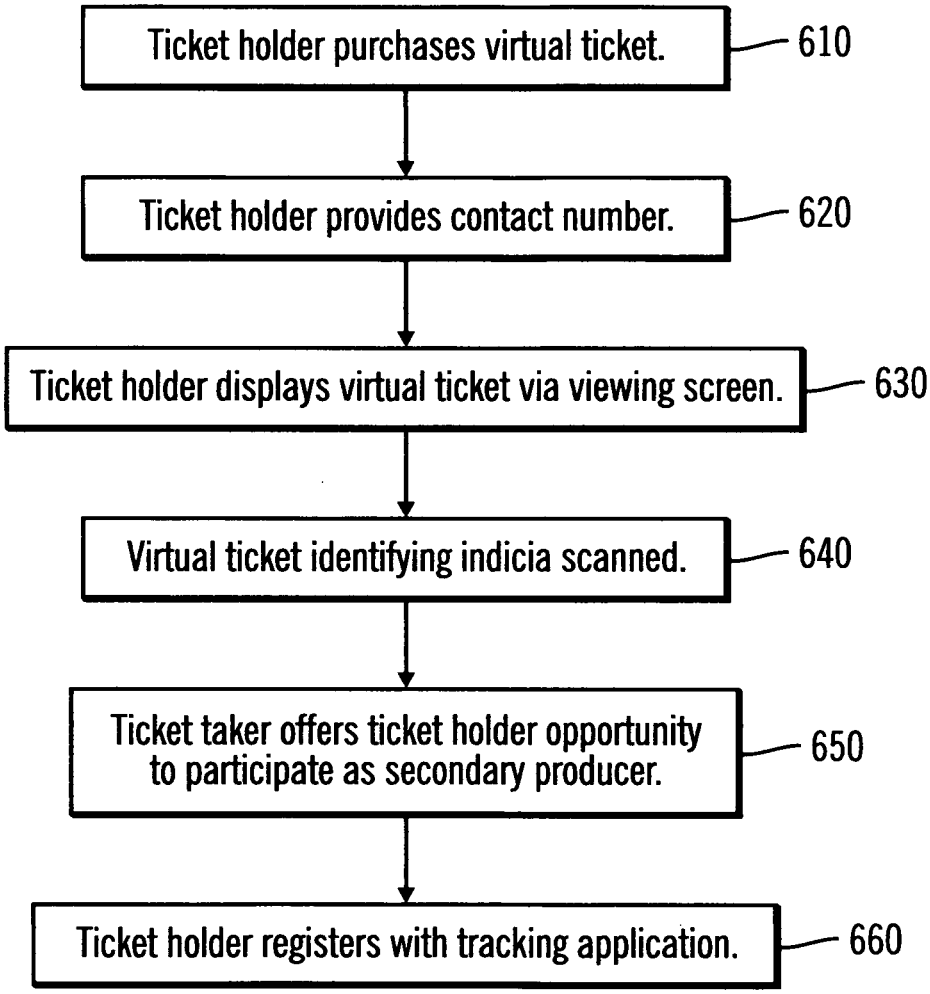

Referring to FIG. 8, the ticket holder purchases a virtual ticket (step 610), on-line, telephonically, in person, or by any other virtual ticket purchasing procedure, and provides telecommunications device identification and/or telecommunications device functionality access and/or control authorization information to the CSPS or to a third party at the time of purchase (step 620). In some embodiments, a virtual ticket so purchased generates a display on a viewing screen of the ticket holder's telecommunication device, which includes identifying indicia, for example a barcode such as a Universal Product Code (UPC) or QR Code, that associates the virtual ticket with a specific seat number or other authorized venue attendance location information for the ticket holder, as well as with other data, such as purchase information, validation information, additional information about the purchaser, etc. Upon arrival at the performance venue, the ticket holder displays the virtual ticket via the viewing screen (step 630). The identifying indicia now displayed on the viewing screen are scanned (step 640), for example by a human ticket taker or by an automated ticket taker as described previously. Either before or after such scanning of the virtual ticket, the CSPS establishes communication with the telecommunication device and the ticket holder is offered, via information displayed on the ticket holder's telecommunication device, an opportunity to participate in a performance as a secondary producer (step 650) via the CSPS. If the ticket holder accepts the offer, the information associated with the ticket holder's ticket, as scanned in step 640, is provided to the CSPS and the telecommunication device and/or its user (e.g., the ticket holder) is registered in the CSPS. In some embodiments, the CSPS includes an application that tracks each participating ticket holder as with preceding embodiments, and the ticket holder is registered as a participating secondary producer (step 660). Once the ticket holder has registered, he or she becomes a potential secondary producer, and information, such as content, applications, instructions, telecommunication device functionality control programs, etc., are then provided to the ticket holder's telecommunication device as discussed above.

Figure 9:
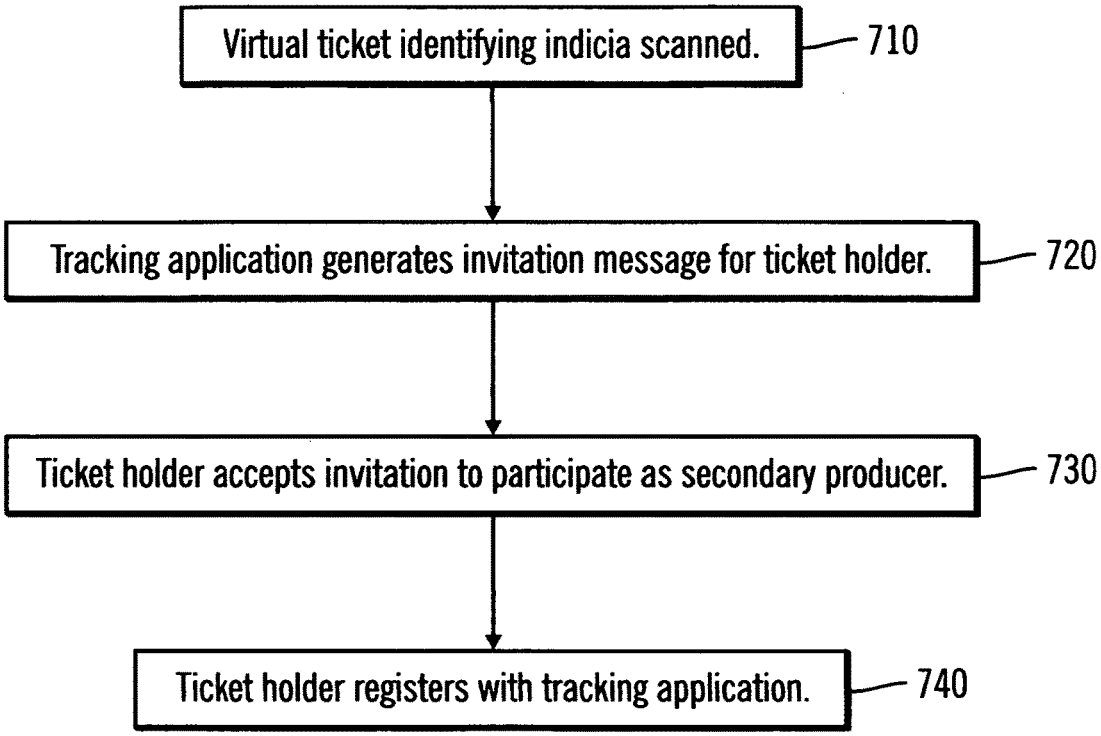
Figures 10A, 10B, 10C:
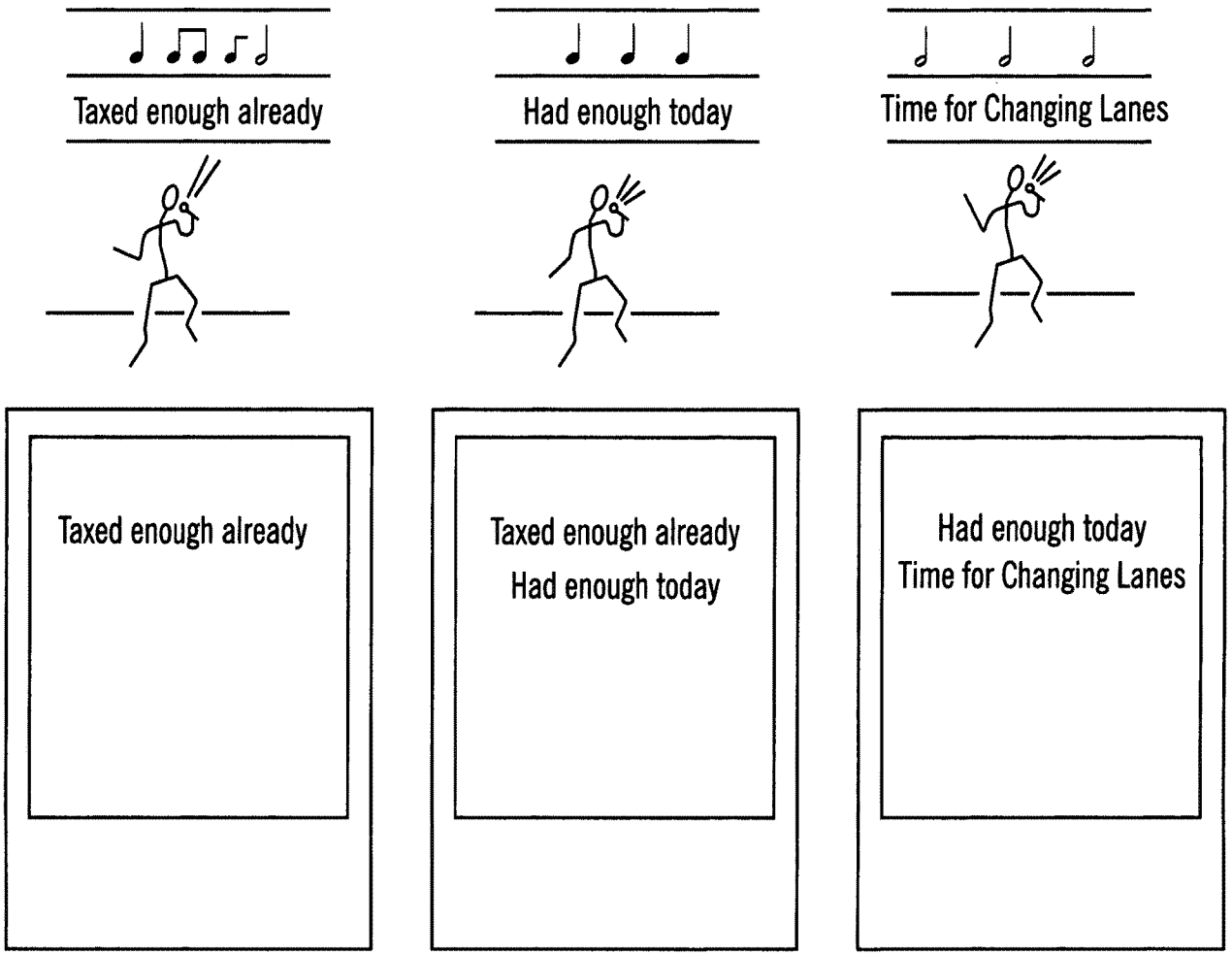
FIGS. 10*a-c* illustrate a method according to the invention in which sung lyrics scroll across a viewer's screen in coordination with the song being sung.

Variant embodiments of the foregoing virtual-ticket method can also be carried out with by providing an automatic invitation to the ticket holder to participate as a secondary producer, the invitation issuing subsequently to the ticket holder upon the telecommunication device in the possession of the ticket entering the performance venue or upon its location within a predetermined zone. In such variant embodiments, after the identifying indicia of the virtual ticket displayed on the viewing screen of the telecommunication device are scanned (FIG. 9, step 710), or otherwise validated (such as by a ticket taking or validation system that utilizes near field communications means) the ticket holder enters the performance venue and takes his or her assigned seat or other location. In some embodiments, after the time the telecommunication device in the possession of the ticket holder has established communication with the CSPS, when the ticket holder enters into the performance venue or into a predetermined zone, the CSPS generates a wireless message, such as a text message, an e-mail, a phone call, or the like, that is received by and reproduced on the ticket holder's telecommunication device in the ticket holder possession (step 720). The ticket holder is next invited to participate as a secondary producer and to provide an appropriate response mechanism, such as the engagement of a affirmation link, button or other graphic (e.g., such as by clicking an "Agree" button) via the telecommunication device's touch screen. If the ticket holder accepts the offer, by, for example, providing a positive response to the wireless message (step 730), the ticket holder and the telecommunication device is registered with the CSPS and the ticket holder becomes a participating secondary producer (step 740). Instructions, content, applications, software, code, etc. are then provided to the ticket holder as described above.

Automatic invitations to participate are also provided, in additional variant embodiments, to ticket holders upon entry into the performance venue independently of whether a physical ticket or a virtual ticket is provided to the ticket taker.

In addition to the methods for locating ticket holders described above, additional methods can be included in further specific embodiments of methods of the invention. Such location methods include, without limitation, location of audience members' telecommunication devices by GPS means, such as those provided, e.g., in U.S. patent application Ser. No. 09/812,296, filed Mar. 20, 2001, AGPS means, Wi-Fi means, local short-range location systems, or the like.

As mentioned, song lyrics can be provided to the secondary producers in order to prompt them to elevate their telecommunication devices at specific points during the performance. Song lyrics and the like can also be provided for reading purposes only, or to help the audience member sing along, if desired.

In addition to the methods described above, additional particular embodiments of methods of the invention make use of the video and audio capturing capacity of cellular telephones and other telecommunication devices that include video cameras or other audiovideo capturing ability. In such embodiments, applications, which may be denoted "videographer applications," which in some embodiments are provided to audience members, to enable the audience members' telecommunication devices to establish communication with the CSPS, and to provide, via their telecommunication devices' audio-visual capturing means, live feeds of the performance, primary performance component(s), the audience members themselves, other audience members, such as those in adjacent or nearby seats, or other live activities of interest, as such audience members view and participate in the performance from their seats or other locations. These feeds are then, in very specific embodiments, provided to one or more appropriate audio-visual feed signal inputting devices associated with the CSPS that enable one or more the producer(s), engineers, etc., to select one or more such feeds provided from one or more such audience member's telecommunication devices, including audio and/or video content, for live display to the audience during the performance. In some embodiments such selected feed(s) from audience members' telecommunication devices are then displayed on the venue's monitors. In some embodiments such feeds are sent to, and displayed on, one or more of the audience members' telecommunication devices. In some embodiments, such feeds are sent to both the venue audiovisual display system and to one or more telecommunication devices in the possession of one or more audience members.

Such "videographer applications" are provided, in specific embodiments, at the time of ticket purchase, at the time of entry into the performance venue, when the audience member occupies the seat corresponding to the ticket purchased while in possession of a telecommunication device adapted to receive the application, or at any other desired time. In some embodiments, one or more applications or part thereof that is(are) already on the audience member's device (e.g., previously provided to or acquired by the audience member for his or her device) are detected and used by the CSPS to provide one or more videographer applications. Such applications can be provided, in various particular embodiments, as part of a package of applications and additional content, or alone. Delivery of specific videographer applications to specific ticket-holders can be accomplished, for example, by GPS means. In more specific embodiments, individualized applications are provided to specific ticket-holders based on their location within the performance venue.

Further particular embodiments provide additional opportunities for audience interaction with one or more performers during a live performance. In certain very particular embodiments, audio and/or video messages from one or more specific performers can be provided to specific audience members during a live performance. Such individualized messages can be provided, in various specific embodiments, to target individuals who request receiving such messages at, e.g., time of ticket purchase, time of entry into the performance venue, or other desired times. Such messages can be provided to telecommunication devices of one or more target individuals based on specific cell phone numbers provided at time of purchase, time of entry into the performance venue, etc., or alternatively, can be provided to locations corresponding to specific ticket numbers by various locational means known to skilled artisans, such as those discussed herein. Various individual audience members can, in certain particular embodiments, select one or more performers from whom messages are desired to be received; alternatively, messages from one or more performers, chosen randomly or non-randomly, can be provided to individual audience members who have expressed no performer preference.

In some preferred embodiments one audience member can transmit live video or live audio and video of the performer(s) from that audience member's location to another audience member or to one or more persons that are not audience members, such as to persons physically outside of the performance venue. In some embodiments, some audience members can provide such views, etc., to others for a fee. In some embodiments, accounting and payment of the fee is provided by the CSPS to the audience member (e.g., by crediting their bank account, providing credit or a proportional discount for a later ticketed event, etc., providing a backstage pass if the audience member did a good job of providing the view, etc.)

In some embodiments, such audiovisual signal feeds generated by telecommunication devices possessed by secondary producer audience members can be aggregated by the CSPS and made available via a wide area network, such as the Internet to other audience members and/or to persons outside of the performance venue. In some embodiments a website is configured to aggregate such secondary producer audiovisual signal feeds ("Secondary Producer Audiovisual Feed Aggregation Website").

In some embodiments, some of the feeds available via such a Secondary Producer Audiovisual Feed Aggregation Website might be available to users of the website in exchange for the payment of a fee or a premium fee. In some embodiments, revenues from such fee payments are shared with the audience member that provided the audiovisual feed.

In addition to directing messages to individual audience members, additional very specific embodiments provide for directing lighting or other effects to individual audience members in order further to enhance audience participation in the live performance. For example, an individual audience member, having a known location determined by seat number, cell phone location or other known location means, provides a live feed of himself or herself singing along with a song being performed by one or more live performers, as discussed above. A producer receiving and monitoring the live feed determines that the audience member's vocal rendition of the song is of interest. The producer ascertains the location of the individual audience member providing the live feed, then instructs one or more crew members to direct lighting toward the individual audience member. In some embodiments, the CSPS employs a audience member location/tracking and spotlighting system as described above. The individual audience member's illuminated image now becomes part of the live feed that audience member provides, and can then be further utilized, e.g., displayed on a large screen to the full audience. Other effects, such as confetti drops, balloon drops, etc, can also be directed toward the individual audience member in a similar way, such as by, but not limited to, the directing of wire suspended or other aerial vehicles such as hovering crafts configured with lights, cameras, and/or effects (such as balloons, etc.) to a particular audience member based on the presumed location of the audience member (e.g., by seat association) or by the location acquired by GPS or any other known telecommunication device locating means In addition to providing applications and/or instructions to audience members, additional specific embodiments provide for control of certain aspects of the function of audience members' telecommunication devices in order to ensure a desired quality of the live performance experienced by audience members. Thus, in certain very specific embodiments, audience members who arrive at a performance venue and agree to participate in the live performance are requested to agree to allow the CSPS operator (e.g., a producer or other person associated with the performance) to assume control of some or all of the functions of their individual telecommunication devices. For example, a particular performance venue may require that a producer assume control of a telecommunication device's camera function such that the camera only operates when the CSPS enables it to operate. Similarly, the venue may require that outgoing and/or incoming calls be disabled during the live performance. Exceptions can be made, in various embodiments, to permit functions such as placing or receiving emergency calls. Such requirements and exceptions can be provided to individual audience members, in certain embodiments, in the form of menus accessed on the audience members' telecommunication devices. In other embodiments, the CSPS and/or venue personnel track the agreement of those individual audience members who agree to comply with the request(s). Audience members who do not agree to comply with the request(s) are not enabled to participate in the live performance using the content, applications, functionalities, etc., with which such requests are associated.

Various embodiments described herein have made use of telecommunication devices. Alternate embodiments make use of devices that are adapted to receive instructions transmitted via radio waves or other forms of electromagnetic radiation, without having the capability to transmit information from an individual audience member to a receiving device. Such devices, upon receipt of transmitted instructions, then activate one or more functions such as light displays, sound generators, etc. Such devices can be incorporated into a wide variety of items, including, without limitation, items of clothing, such as shirts, pants, skirts, or shoes; wristbands, headbands, or hats; accessories such as pins, brooches, necklaces, pendants, watches or eyeglasses; purses or backpacks; or any other item capable of being provided with a device that receives radio or other remotely-transmitted instructions. In very particular embodiments, the devices further include location identification means, such as GPS receivers, and are adapted to transmit location identification information in response to instructions received.

In particular embodiments making use of such items and devices, some or all of the devices can be selectively activated to produce displays of lights, sounds, etc. Thus, very specific embodiments produce patterns of pixels, each pixel produced by a light-emitting element included in devices as described above which are activated in response to instructions transmitted to them, in a manner similar to the above-described embodiments employing activated screens of telecommunication devices to produce such patterns of pixels.

In some embodiments, the CSPS provides users thereof with the ability to generate and conduct games involving audience members. For example, the CSPS can be configured to provide to participating audience members' telecommunication devices a game application in which audience members may virtually move a virtual ball or other game object among the members of the audience. you can get a representation of gaming space. For example, a participating audience member's telecommunication device would generate and display a game space, corresponding to the venue, and a virtually movable game object, such as a virtual ball that could be virtually "tossed" by the participating audience member by appropriate control configuration, such as by moving a telecommunications device configured with gesture control in a predetermined manner. In some embodiments such a toss would cause the virtual ball to assume a virtual trajectory tracked and displayed on all the participating audience members' telecommunications devices. If the virtual ball is shown by the game to arrive at a particular audience member's location (seat location, or location determined by any of the means described above), the audience member's telecommunication device is provided with the means to enable the audience member in possession of the telecommunication device to re-launch the virtual ball, with succeeding rounds of similar play to follow.

In some embodiments, the game is played just for fun. In some other embodiments, a monetary or other reward may be provided to a participating audience member associated with a specified location at which such a virtual ball in such a game lands. For example, if the game engine randomly selects a particular location corresponding with a seat number, say B103 as the winning location, the virtual ball play would continue until a "toss" to that particular location is effectuated. In some embodiments, the player that initiated such a winning "toss" of the virtual ball would win the reward. In some embodiments, the audience member located at the winning location at which the virtual ball lands is the winner. In some embodiments where the location of the landing of the virtual ball determines the winning or not winning result, to incentivize a player to keep the game going by tossing the virtual ball even though the audience participant was not at the winning location, the game can be configured to provide a part of the reward to In some embodiments, the launch of the virtual ball or other gaming object can use any number of applications or control means, such a Wii controller technology, that are well known in the are.

In some embodiments the aforementioned virtual ball game is effectuated as an augmented reality application whereby participating audience members use a head's up display, such as Google Glass, to be able to both see the actual venue (i.e., the game space) and the virtual ball projected on the heads-up display device.

In some embodiments, where the audio playing and/or visual display functionality of one or more secondary producer/audience member telecommunication devices is appropriately under the control of the CSPS, when a winner is determined an appropriate graphic or video associated with appropriate sound generation can be produced on all or a subset of all of the telecommunication devices in the possession of participating audience members.

In some embodiments, where a participating audience member's telecommunication device will provide the means for the CSPS to track the participating audience member's location in association with the location of the telecommunication device in the audience member's possession, the CSPS can also provide to advertisers, promoters, etc., useful information about the participating audience member in association with the audience members attendance at, and/or participation in, the subject performance. For example, if the ticket holder registered the ticket holder's telecommunication device at the time of an online purchase prior to the ticket holder's travelling to the performance venue, and if the CSPS was configured to receive location information from the telecommunication device, the CSPS could obtain valuable data regarding the route that the ticket holder takes to the performance venue. Similarly, information about the movements of the participating audience member determined from the geo-tracking of the participating audience member's telecommunication device by the CSPS can similarly be obtained. In some embodiments, such locational information can be used to send advertisements, coupons, etc., to the participating audience member based on the actual location of the audience member's telecommunication device, predicted location(s), such as when a participating audience member is assumed to use the same route leaving the performance venue as the participating audience member used coming to the venue.

In some preferred embodiments, such as where the CSPS interfaces or is otherwise in communication with social media technology, such as Facebook®, Twitter®, Linkedin®, and/or where the CSPS has its own database of participating audience member information, the CSPS can, among other things, be used to provide to participating audience members disclosure of any friends or other persons of interest that are in attendance, provide a means of locating such persons, provide a means of contacting such persons, inviting such persons to a subsequent event, provide one or more such persons with an audio, visual or audiovisual feed of the performance or other views from the audience participant's location, etc.

In some embodiments, such personal and locational information available in the CSPS regarding participating audience members can be used by performers, advertisers and other providers of products or services. For example, an advertiser, such as Starbucks might contract with the CSPS operator to provide an advertisement that will appear on a selected participating audience member's telecommunication device display that communicates a targeted advertising message such as, "Hello, Greg, we at Starbucks hope you enjoyed the Springsteen concert. Guess what? Your friends, Anna, Michael and Alexa are all here too! Since you and Anna, Michael and Alexa are all close to the Starbucks at 123 First St, we would like to invite you and your friends to meet up at the Starbucks at 123 First St where we will give you each a $10 coupon."

What is claimed is:

1. A collaborative show production system (CSPS), comprising:

a telecommunication device associated with an audience member having a plurality of features and location data, where the location data is generated in the telecommunication device with at least a GPS receiver and the location data is associated with an actual location of the telecommunication device;

a network; and a server in communication with the telecommunication device that controls at least one of the plurality of features of the telecommunication device during a performance enabling the telecommunication device to become part of the performance, where the telecommunication device has granted permission for the server to control the at least one of the plurality of features of the telecommunication device in real time during the performance.

2. The CSPS of claim 1, where the plurality of features includes a display.

3. The CSPS of claim 2, where the server further includes performance data that is sent via the network to the telecommunication device for displaying on the display of the telecommunication device during the performance.

4. The CSPS of claim 1, where the telecommunication device is selected to receive performance data by the server in response to the location data provided by the telecommunication device.

5. The CSPS of claim 4, where the telecommunication device one of a plurality of telecommunication devices selected where each is selected based upon location data.

6. The CSPS of claim 1, where the plurality of features includes a microphone.

7. The CSPS of claim 6, where the server further includes activation of the microphone at the telecommunication and receipt of audio data from the microphone in response to location data provided by the telecommunication device.

8. The CSPS of claim 1, where the server provides an application to the telecommunication device via the network and the application synchronizes activation of at least one of the plurality of features with the performance.

9. The CSPS of claim 1, where the plurality of features include a display and a speaker.

10. The CSPS of claim 1 where the telecommunication device is a cellular telephone.

11. A method for a collaborative show production system (CSPS), comprising the steps of:

identifying a telecommunication device associated with an audience member having a plurality of features and location data, where the location data is generated at the telecommunication device with at least a GPS receiver and the location data is associated with an actual location of the telecommunication device; and communicating with a server with the telecommunication device over a network, where the server controls at least one of the plurality of features of the telecommunication device during a performance enabling the telecommunication device to become part of the performance in real time, where the telecommunication device has granted permission for the server to control the at least one of the plurality of features of the telecommunication device.

* * * * *